US010010464B2

(12) United States Patent
Dewert

(10) Patent No.: US 10,010,464 B2
(45) Date of Patent: Jul. 3, 2018

(54) ADJUSTABLE SUPPORT DEVICE ADJUSTABLE BY AN ELECTRIC MOTOR

(71) Applicant: de Werth Group AG, Zurich (CH)

(72) Inventor: Eckhart Dewert, Goldingen (CH)

(73) Assignee: de Werth Group AG, Zurich (CH)

( * ) Notice: Subject to any disclaimer, the term of this patent is extended or adjusted under 35 U.S.C. 154(b) by 78 days.

(21) Appl. No.: 14/800,414

(22) Filed: Jul. 15, 2015

(65) Prior Publication Data

US 2016/0015583 A1 Jan. 21, 2016

(30) Foreign Application Priority Data

Jul. 18, 2014 (DE) ..... 10 2014 110 114
Oct. 17, 2014 (DE) ..... 10 2014 115 126

(51) Int. Cl.

| | |
|---|---|
| ***A61G 7/018*** | (2006.01) |
| ***A47C 20/04*** | (2006.01) |
| ***A61G 7/002*** | (2006.01) |
| ***A47C 19/12*** | (2006.01) |
| ***A61G 7/015*** | (2006.01) |

(52) U.S. Cl.

CPC ..... *A61G 7/018* (2013.01); *A47C 19/12* (2013.01); *A47C 20/04* (2013.01); *A47C 20/041* (2013.01); *A61G 7/002* (2013.01); *A61G 7/015* (2013.01)

(58) Field of Classification Search

CPC ..... A61G 7/002; A61G 7/015; A61G 7/018; A47C 19/12; A47C 20/04; A47C 20/041

See application file for complete search history.

(56) References Cited

U.S. PATENT DOCUMENTS 2,751,606 A * 6/1956 Benker ..... A61G 7/015 5/614
2,819,475 A * 1/1958 Ericsson ..... A61G 7/015 5/614

(Continued)

FOREIGN PATENT DOCUMENTS

DE 3103922 A1 8/1982
DE 3409223 A1 9/1985

(Continued)

OTHER PUBLICATIONS

Office Action in European Patent App. No. 15 002 099.8 related to U.S. Appl. No. 14/800,414, filed Jul. 15, 2015 & 3 pg. European Search Report, dtd 18 dated Nov. 20, 2015 (6 pages).

*Primary Examiner* — Robert G Santos
*Assistant Examiner* — David R Hare
(74) *Attorney, Agent, or Firm* — Shlesinger, Arkwright & Garvey LLP

(57) ABSTRACT

An adjustable support device adjustable by an electric motor, for supporting padding of seating or reclining furniture has an outer frame and a base body having at least two support parts. The two support parts are adjustable relative to one another. An adjustment element, which is in drive connection with a drive unit, is associated with at least one of the adjustable support parts. The adjustment element is a pivot lever which is pivotable under the traction effect of a pull cable of a Bowden cable, and the pivot lever is pivotably connected to the associated support part, and is supported on a support situated on the outer frame. Or the pivot lever is pivotably connected to the outer frame, and with its free end forms a support for the support part to be adjusted.

7 Claims, 32 Drawing Sheets

(56) References Cited

U.S. PATENT DOCUMENTS

| | | | | | |
|---|---|---|---|---|---|
| 2,913,300 | A * | 11/1959 | Darnell | A61G 7/002 | 477/8 |
| 3,414,913 | A * | 12/1968 | Stanley | A61G 7/002 | 5/616 |
| 4,774,732 | A * | 10/1988 | Riedl | A47C 20/047 | 297/354.12 |
| 5,105,486 | A * | 4/1992 | Peterson | A47C 19/045 | 5/611 |
| 5,528,948 | A | 6/1996 | De Gelis | | |
| 5,926,877 | A * | 7/1999 | Lin | A47C 20/041 | 297/330 |
| 6,754,922 | B2 * | 6/2004 | Dewert | A47C 20/041 | 5/613 |
| 6,961,971 | B2 | 11/2005 | Schneider et al. | | |
| 7,484,257 | B2 * | 2/2009 | Schneider | A47C 20/041 | 5/613 |
| 7,770,972 | B2 * | 8/2010 | Popa | B60N 2/0296 | 297/284.4 |
| 2002/0113472 | A1 * | 8/2002 | Blendea | B60N 2/0232 | 297/284.4 |
| 2003/0052238 | A1 * | 3/2003 | Schneider | A47C 20/08 | 248/157 |
| 2003/0079290 | A1 * | 5/2003 | Dewert | A47C 20/041 | 5/618 |
| 2014/0020179 | A1 * | 1/2014 | Brougham | A61B 6/0407 | 5/601 |
| 2014/0191553 | A1 * | 7/2014 | Blendea | B60N 2/20 | 297/354.1 |
| 2015/0074908 | A1 * | 3/2015 | Dewert | A47C 20/041 | 5/616 |
| 2016/0037937 | A1 * | 2/2016 | Dewert | A47C 1/0242 | 5/616 |
| 2016/0157623 | A1 * | 6/2016 | Dewert | A47C 17/16 | 5/616 |

FOREIGN PATENT DOCUMENTS

| | | | |
|---|---|---|---|
| DE | 3842078 | A1 | 7/1989 |
| DE | 3900384 | C1 | 10/1990 |
| DE | 29602947 | U1 | 8/1996 |
| DE | 29714746 | U1 | 11/1997 |
| DE | 29811566 | U1 | 1/1998 |
| DE | 19843259 | C1 | 12/1999 |
| DE | 10017979 | A1 | 6/2001 |
| DE | 10017989 | A1 | 10/2001 |
| DE | 10 2006 017972 | A1 | 10/2007 |
| DE | 102008028586 | A1 | 12/2009 |
| EP | 0788325 | A1 | 5/1996 |
| EP | 1020171 | A1 | 7/2000 |
| EP | 1633219 | A1 | 12/2004 |
| EP | 2878230 | A1 | 6/2015 |
| FR | 2727296 | A1 | 5/1996 |
| GB | 2334435 | A | 8/1999 |
| SE | 501634 | C2 | 4/1995 |
| WO | WO 9629970 | A1 | 10/1996 |
| WO | WO 00/16663 | A1 | 3/2000 |
| WO | WO 2008113401 | A1 | 9/2008 |

* cited by examiner

ADJUSTABLE SUPPORT DEVICE ADJUSTABLE BY AN ELECTRIC MOTOR

CROSS REFERENCE TO RELATED APPLICATIONS

This application claims the priority of German Application No. 10 2014 115 126.7, filed Oct. 17, 2014, and this application claims the priority of German Application No. 10 2014 110 114.6, filed Jul. 18, 2014, and each of which is incorporated herein by reference.

FIELD OF THE INVENTION

The invention relates to an adjustable support device adjustable by an electric motor for padding of seating and/or reclining furniture. More particularly, the invention relates to an adjustable support device adjustable by an electric motor for padding of seating and/or reclining furniture, such as a mattress of a bed.

BACKGROUND OF THE INVENTION

Support apparatuses of this type are generally known, for example, in the form of slatted frames.

For adjusting slatted frames, for example, so-called double drives are known which have a housing, designed as a separate component which is connectable to the slatted frame, and in which two adjustment units are accommodated, one of which is used, for example, for adjusting a back support part, and the other for adjusting a leg support part of the slatted frame. In the known double drives, the adjustment units are designed as a spindle drive, the drive coupling taking place at a support part, which is to be adjusted, via a coupling lever which is connected in a rotationally fixed manner to a pivot shaft which is associated with the support part to be adjusted. For adjusting the support part, the spindle nut of the spindle drive presses against the coupling lever, so that the pivot shaft, and thus the support part, swivels. Double drives of this type are known from EP 0372032 A1 and DE 3842078 A1, for example.

A furniture drive designed as a double drive is known from both DE 10017989 C2 and DE 10017979 C2, in which each adjustment unit has an electromotively driven winding device for a traction means, in the form of a cable, belt, or chain, which is connected in the manner of a pulley block to a pivot lever which is connected in a rotationally fixed manner to a pivot shaft, which in turn is in operative connection with a support part to be adjusted.

Furniture drives which operate according to a similar principle are also known from DE 3409223 C2, DE 19843259 C1, and EP 1020171 A1.

Furthermore, double drives which operate according to different principles are known from DE 197292812 A1, DE 29811566 U1, and DE 29714746 U1.

An adjustable slatted frame is known from DE 3900384 in which the adjustment of a head support part or leg support part of the slatted frame takes place by means of a pneumatic cylinder.

A gas spring adjustment fitting for slatted frames is known from DE 29602947 U1, in which a pull cable is provided for actuating the gas spring.

A slatted frame is known from DE 3103922 A1 in which the adjustment of an upper body support part, for example, takes place via a windshield wiper motor and a scissor lift.

A double drive is known from EP 1294255 B1 in which the transmission of force from a linear movable drive element to a pivot lever, which is in operative connection with a pivot shaft that is in operative connection with a support part to be adjusted, takes place via a pulley block. Similar furniture drives are also known from FR 2727296, DE 3409223 C2, DE 19843259 C1, GB 2334435, and U.S. Pat. No. 5,528,948.

In addition, slatted frames are known in which the adjustment apparatus for adjusting a support part is partially or completely integrated into a base body of the slatted frame. In this sense, DE 19962541 C2 (corresponding to EP 1239755 B1, JP 2001-546280, and U.S. Pat. No. 6,754,922) discloses and describes an electromotively adjustable support apparatus having a first support part which has mutually parallel longitudinal beams, and which in the support apparatus known from the cited publication is formed by a stationary center support part. The known support apparatus also has further support parts, which are adjustable relative to the first support part by a drive means. In the support apparatus known from the cited publication, a first longitudinal beam of the first support part for accommodating the drive means is designed as a hollow profile, wherein the entire drive, including a drive motor, is accommodated in the hollow longitudinal beam. For this reason, the drive motor does not protrude beyond the first longitudinal beam in the vertical direction thereof, so that the support apparatus known from the cited publication has an extremely small installation height. A similar support apparatus is also known from DE 10046751 (corresponding to EP 1239754 B1, JP 2001-547994, and U.S. Pat. No. 6,961,971).

A motor-adjustable support apparatus for a mattress of a bed is known from WO 96/29970, having multiple support parts following one another in the longitudinal direction of the support apparatus, which are pivotable relative to a first support part via a drive means. The support parts are supported on an outer frame whose profile height is significantly greater than the profile height of the support parts. In the support apparatus known from the cited publication, portions of the outer frame are designed as a hollow profile, and portions of the drive means for adjusting the support parts relative to one another are accommodated in the hollow profile. The drive motor is situated on an inner side of a portion of the outer frame.

A motor-adjustable support apparatus for a mattress of a bed is known from DE 69507158 T2 (corresponding to EP 0788325 B1), having a first support part which has a longitudinal beam, and at least one second support part which is pivotable relative to the first support part via a drive means. In the known support apparatus, the drive motor is situated outside the base area of the support apparatus and is fastened to a frame-like extension of the first support part.

A slatted frame is known from EP 1633219 B1, in which portions of the adjustment apparatus are accommodated in a hollow longitudinal beam, while the drive motor is situated outside the longitudinal beam, and through a recess is in drive connection with the portions of the adjustment apparatus accommodated in the longitudinal beam.

A furniture drive which is provided for adjusting a drawer relative to a body of a cabinet is known from WO 2008/113401, in which the adjustment of the drawer takes place via a flexible toothed rack which is in engagement with a gearwheel.

A slatted frame having an integrated adjustment apparatus is known from DE 10 2008 028586 A1, in which the transmission of force from drive motors of the adjustment apparatus to the support parts to be adjusted takes place via pull cables which are guided over deflection points.

Electromotively adjustable slatted frames generally have an adjustment fitting which is used to transmit the adjustment force from an electric motor or multiple electric motors to the mutually adjustable support parts of the slatted frame. For installing an electromotively adjustable slatted frame, for example, a double drive is mounted on the slatted frame in such a way that the adjustment elements of the double drive enter into operative connection with the adjustment fitting of the slatted frame.

OBJECTS AND SUMMARY OF THE INVENTION

An object of the invention is to provide an adjustable support device adjustable by an electric motor, and which has a relatively small installation height and has a simple and economical design.

This object is achieved by the invention set forth herein.

The invention includes an adjustable support device adjustable by an electric motor, for supporting padding of seating or reclining furniture, and which includes an outer frame and a base body having a first and second support part which are adjustable relative to one another. At least one of the first and second adjustable support parts is associated with an adjustment element which is in drive connection with a drive unit, and the adjustment element is a pivot lever which is pivotable under the traction effect of a pull cable of a Bowden cable. Further, the pivot lever is either:

i) pivotably connected to the associated support part and being supported on a support situated on being the outer frame; or ii) pivotably connected to the outer frame, and with its free end forming a support for the support part to be adjusted.

The invention provides that the adjustment element is a pivot lever which is pivotable under the traction effect of a pull cable of a Bowden cable. According to a first embodiment of the basic principle of the invention, the pivot lever is pivotably connected to the associated support part, and is supported on a support situated on the outer frame. The adjustment of the support part is completed in such a way that the pivot lever is pivoted under the traction effect of the pull cable of the Bowden cable, and is supported on the support. Due to the pivotable connection to the associated support part, the support part is pivoted when the pivot lever pivots, and is thus adjusted in the desired manner. For this purpose, in addition to the Bowden cable and the associated drive unit, only two components are necessary, namely, the pivot lever which is pivotably connected to the support part to be adjusted, and the support. This results in a particularly simple and cost-effective design.

In an unadjusted starting position of the support part, in which it spans an essentially horizontal support plane, the pivot lever may be situated within the profile height of the outer frame. Since a drive unit for actuating the Bowden cable in the direction of the profile height of the outer frame may also have a very small installation height, an electromotively adjustable support apparatus according to the invention has a very small installation height which is not greater, or is only insignificantly greater, than the installation height of a support apparatus which is not electromotively adjustable.

For example and in particular, the support may be fastened to the outer frame directly, i.e., without other components in between; in this sense, a fastening means, for example screws, may be used for the direct fastening. The support may be formed by a separate component. However, it may also be formed in one piece with the outer frame.

In a kinematic reversal of the above-described embodiment of the basic principle of the invention, it is provided that the pivot lever is pivotably connected to the outer frame, and with its free end forms a support for the support part to be adjusted. The same advantages result as in the previously described embodiment. In this embodiment, the pivot lever, for example and in particular, may be fastened to and supported on the outer frame directly, i.e., without other components in between; for example and in particular, the pivot axis of the pivot lever may be formed by a bearing journal which is fastened to the outer frame or formed in one piece with same.

In the embodiment in which the support is situated on the outer frame, the support may in particular be formed in one piece with the outer frame when the outer frame is made of injection-molded parts. In particular when the outer frame is made of wood, as is customarily the case, it is advantageous when the support situated on the outer frame is formed on a component that is connected to the outer frame. In this embodiment, for example and in particular the component may be made of metal and screwed to the outer frame.

A further embodiment of the above-mentioned design provides that the component connected to the outer frame is an angle bracket on whose one leg the pivot lever is supported, and to whose other leg the outer frame is connected.

Another advantageous further embodiment of the invention provides that the pivot lever is designed as a raising lever.

The invention is explained in greater detail below based on one embodiment, with reference to the appended drawings. All features which are described, illustrated in the drawings, and claimed in any suitable combination, constitute the subject matter of the present invention, regardless of their wording or illustration in the description or drawings, respectively.

Relative terms such as left, right, up, and down are for convenience only and are not intended to be limiting.

DETAILED DESCRIPTION OF THE INVENTION

First, the basic mode of operation of an electromotively adjustable support apparatus which will be understood to include a support apparatus adjustable by an electric motor is explained below with reference to FIGS. 1 to 14, in which the adjustment is effected via Bowden cables.

Figure 1:
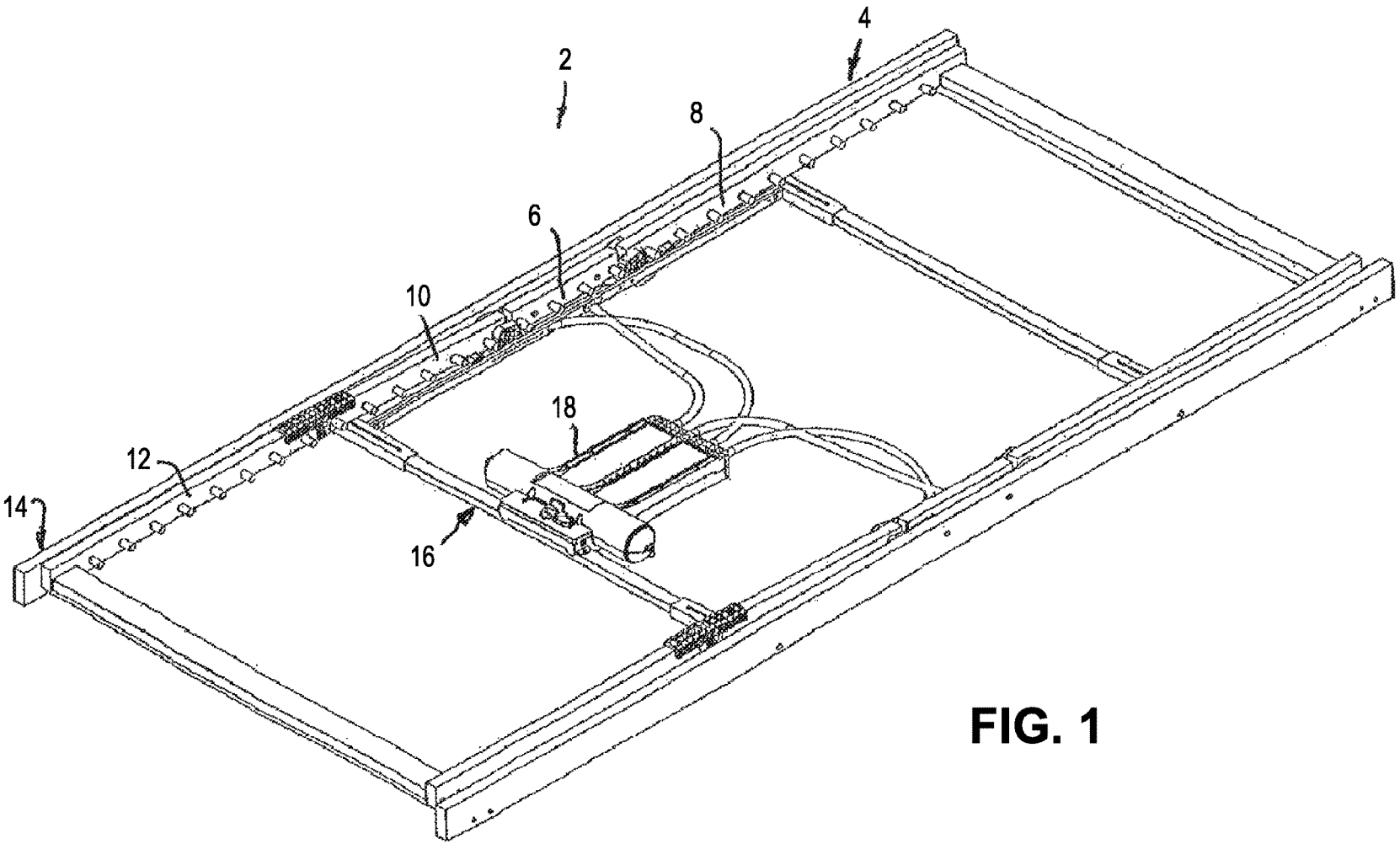
FIG. 1 shows in a perspective view one embodiment of an electromotively adjustable support apparatus in the form of a slatted frame, in an unadjusted position.

FIG. 1 illustrates in a perspective illustration one embodiment of an electromotively adjustable support apparatus for padding of seating and/or reclining furniture, in particular a mattress of a bed, in this embodiment the support apparatus being designed as a slatted frame 2. For the sake of clarity, elastic slats of the slatted frame 2, for example resilient wooden strips, are not illustrated in the drawing. However, the design and attachment of these types of elastic slats are generally known to those skilled in the art and therefore are not explained in greater detail.

The slatted frame 2 has a base body 4 on which support parts which are adjustable relative to one another are situated. In the illustrated embodiment, the support parts have a stationary center support part or first support part 6, one end of which is articulatedly connected to an upper body support part or second support part 8 and pivotable about a horizontal pivot axis. The end of the center support part 6 facing away from the upper body support part 8 is articulatedly connected to a support part 10 and pivotable about a horizontal pivot axis, and the end of the support part 10 facing away from the center support part 6 is articulatedly connected to a calf support part 12 and pivotable about a horizontal pivot axis.

In the illustrated embodiment, the base body of the slatted frame 4 has an outer frame 14.

The support parts 6 to 12 are connected to the outer frame 14 via a mounting frame 16, on which a drive unit 18 and adjustment elements which are or may be acted on by the drive unit with an adjustment force are situated for acting with an adjustment force on a support part to be adjusted, in a mounting position of the mounting frame 16. The mounting frame 16 is explained in greater detail below with reference to FIGS. 2 to 4. The drive unit 18 is explained in greater detail below with reference to FIGS. 5 and 6. In the illustrated embodiment, adjustment elements of the mounting frame 16 are formed by raising levers, which are explained in greater detail below with reference to FIGS. 7 to 10.

Figure 2:
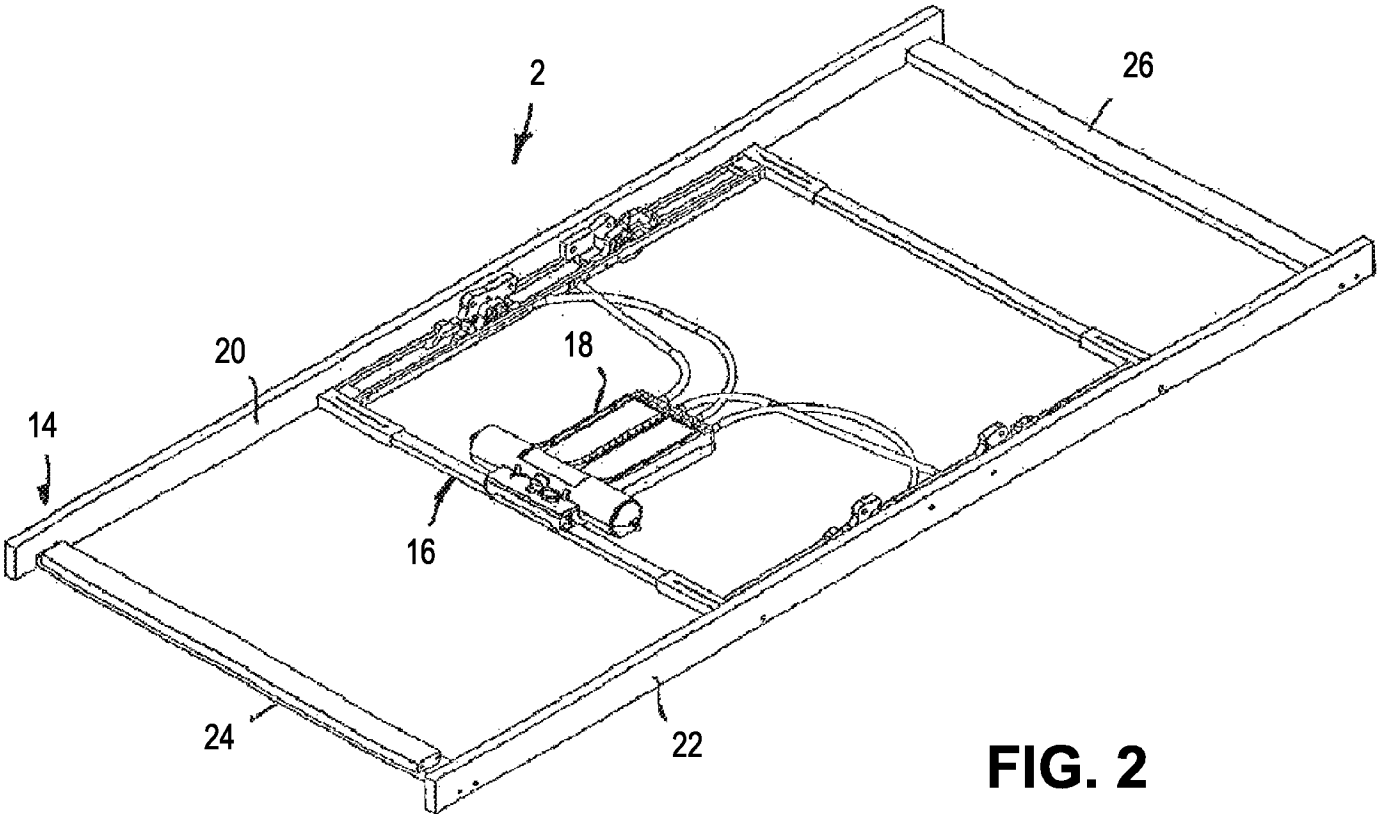
FIG. 2 shows, in the same manner as FIG. 1, the slatted frame according to FIG. 1 with support parts of the slatted frame omitted for the sake of clarity.

FIG. 2 shows the outer frame 14 of the slatted frame 2 with a mounting frame 16 fastened thereto, the support parts 6 to 12 being omitted in FIG. 2 for the sake of clarity. As is apparent from FIG. 2, the outer frame 14 has longitudinal beams 20, 22 at a lateral distance from one another and extending in the longitudinal direction of the slatted frame 2, and which are connected to one another in the area of their ends via transverse beams 24, 26. In the context of the invention, the longitudinal direction of the slatted frame 2 is defined as the direction along which the slatted frame 2 has the larger extension. Accordingly, the transverse direction of the slatted frame 2 is defined as the direction along which the slatted frame 2 has the smaller extension.

Figure 3:
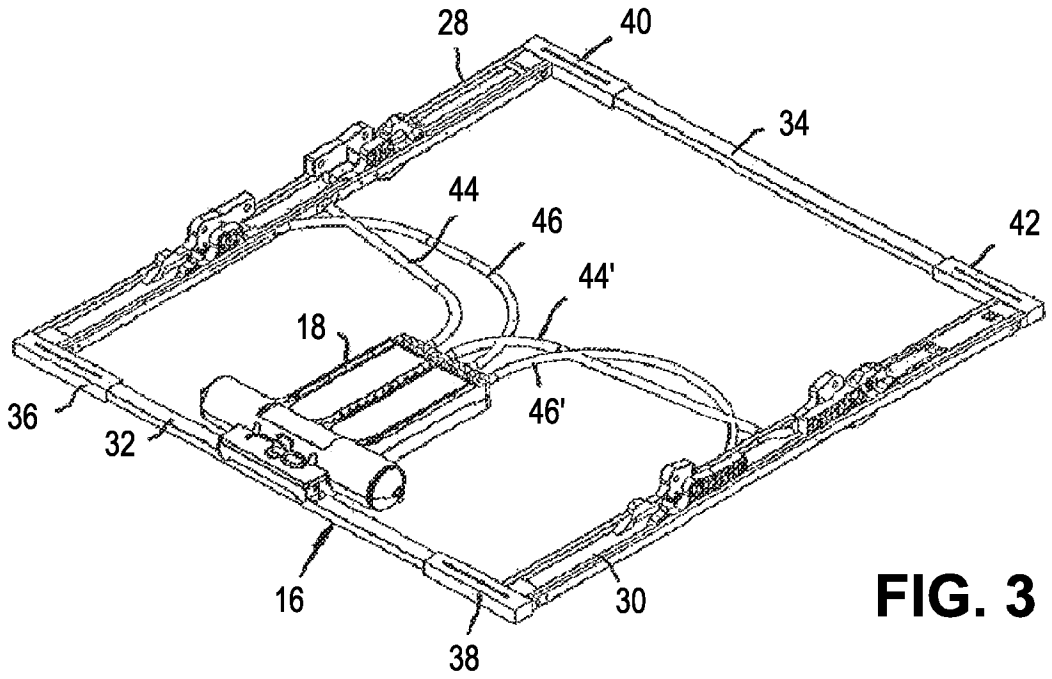
FIG. 3 shows, in the same manner as FIG. 1, a mounting frame of the support apparatus according to FIG. 1.

FIG. 3 shows the mounting frame 16 by itself, i.e., independently of the slatted frame 2. The mounting frame 16 has longitudinal beams 28, 30 which are connected to one another in the area of their ends via transverse beams 32, 34. In the illustrated embodiment, the transverse beams 32, 34 are each formed by a profile rail having the cross section of a horizontal letter "C," and are situated or guided in the adjustment elements of the mounting frame 16, as explained in greater detail below with reference to FIG. 11.

In the illustrated embodiment, the mounting frame 16 has a width-adjustable design for adapting to slatted frames of different widths. For achieving the width adjustability, telescoping elements 36, 38 and 40, 42, which in the illustrated embodiment are designed as tube parts and extend at right angles to the longitudinal beams 28 and 30, are each situated on the longitudinal beams 28, 30 of the mounting frame 16, extending toward the respective other longitudinal beam 30, 28. In the illustrated embodiment, the ends of the transverse beam 32 are guided in a telescoping manner into the telescoping elements 36, 38. The ends of the transverse beam 34 are correspondingly guided in a telescoping manner into telescoping elements 40, 42.

In the illustrated embodiment, the drive unit 18 is situated on the transverse beam 32, and is displaceable in the beam direction of the transverse beam 32 and lockable in the respective position.

For transmitting force from electric motors of the drive unit 18 to the support parts 6 to 12 to be adjusted, in the illustrated embodiment Bowden cables 44, 44' and 46, 46' are provided which are each associated with an adjustment element. The cooperation of the Bowden cables 44, 44', 46, 46' with the drive unit 18 and the adjustment elements is explained in greater detail below with reference to FIGS. 5 to 7.

For installing the mounting frame 18 on the outer frame 14 of the slatted frame 2, initially the width of the mounting frame 16 (see FIG. 3) is set corresponding to the width of the outer frame 14 (see FIG. 2) of the slatted frame 2. In particular, the longitudinal beams 28, 30 of the mounting frame 16 are pulled apart far enough that the spacing of the outer surfaces of the longitudinal beams 28, 30 of the mounting frame corresponds to the inside width between the inner surfaces of the longitudinal beams 20, 22 of the outer frame 14. The transverse beams 32, 34 of the mounting frame 16 thus slide into the telescoping elements 36, 38 and 40, 42, respectively. After the desired width is set, the mounting frame 16 is inserted into the outer frame, as illustrated in FIG. 2. The mounting frame 16 may be subsequently fastened to the outer frame 14, for example by screwing.

After the mounting frame 16 is installed on the outer frame 14, the support parts 6 to 14 of the slatted frame 2 may be connected to the mounting frame 16.

Figure 4:
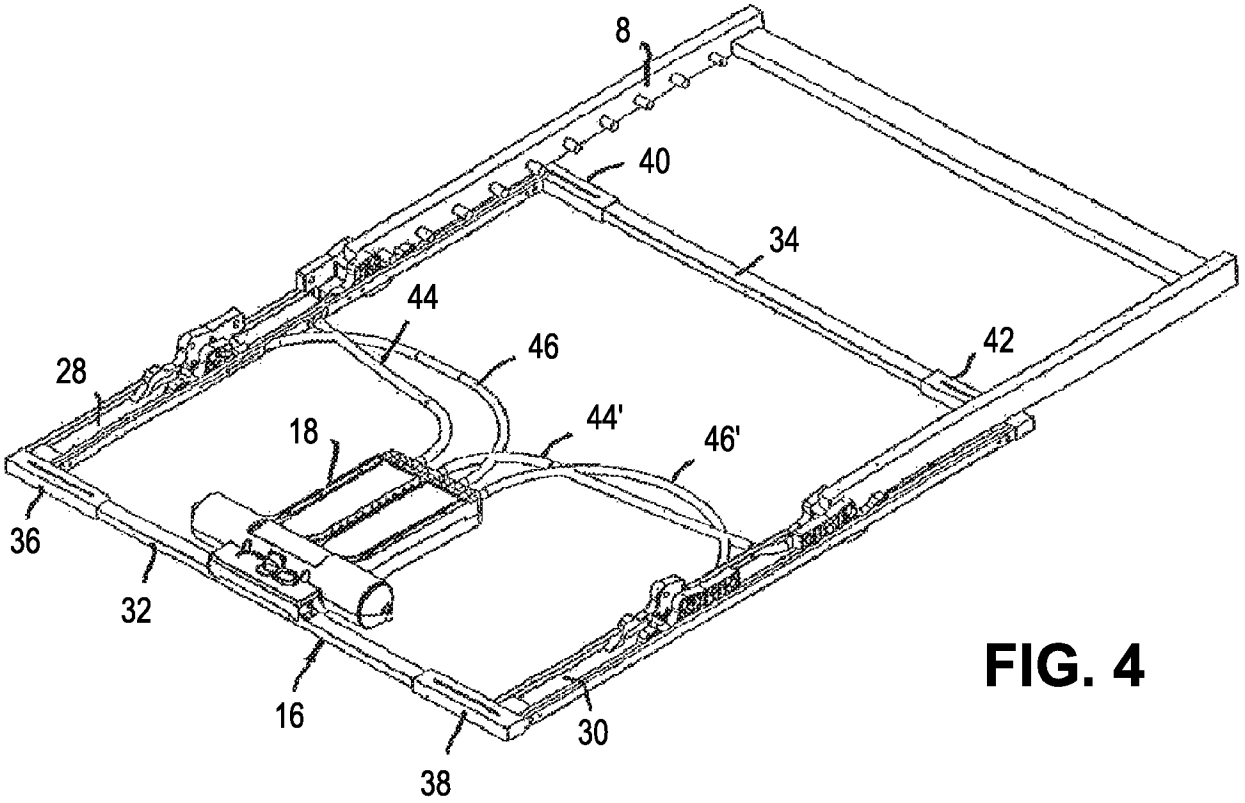
FIG. 4 shows, in the same manner as FIG. 3, the mounting frame according to FIG. 3 together with a support part pivotably supported thereon.

FIG. 4 shows an example of a connection of the upper body support part 8 to the mounting frame 16. The connection of the leg support part 10 in addition to the calf support part 12 which is connected thereto takes place in a corresponding manner, and therefore is not explained here in greater detail. For connecting to the upper body support part 8, a bearing apparatus for pivotably supporting at least one pivotably adjustable support part is formed on the mounting frame, in the illustrated embodiment the bearing apparatus having bearing bushes at a lateral distance from one another, into which the upper body support part 8 is insertable with bearing journals at a lateral distance from one another. FIG. 4 shows the upper body support part 8 pivotably mounted on the mounting frame 16 in this way.

Figure 5:
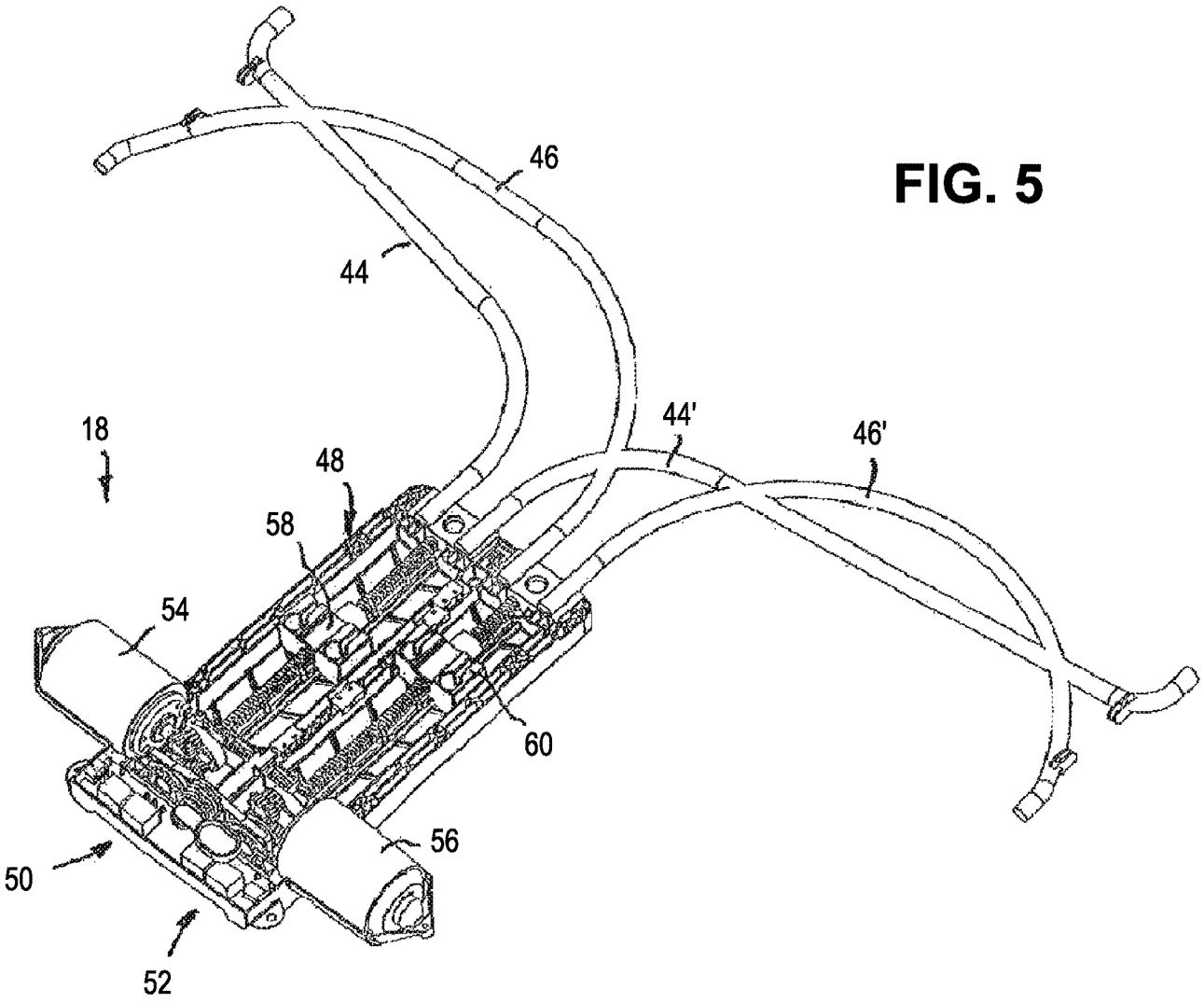
FIG. 5 shows in a perspective illustration a drive unit of the slatted frame according to FIG. 1, with the housing of the drive unit shown open for purposes of illustration, and components of the drive unit omitted for the sake of clarity.

FIG. 5 shows the drive unit 18 in a perspective view, with the housing 48 of the drive unit 18 shown open for purposes of illustration. The drive unit 18 has two drive trains 50, 52 with which an electric motor 54, 56, respectively, is associated, and whose output members are formed by spindle nuts 58, 60, respectively. The sheathings of the Bowden cables 44, 44' and 46, 46' are fixed to the housing 48 of the drive unit 18, while the pull cables of the Bowden cables are fixed in pairs to the spindle nuts 58, 60. In the illustrated embodiment, the pull cables of the Bowden cables 44, 44' are fixed to the spindle nut 58, while the pull cables of the Bowden cables 46, 46' are fixed to the spindle nut 60. The electric motors 54, 56 are controllable independently of one another. The control means for controlling the electric motors 54, 56 is not illustrated in the drawing for reasons of clarity. The same applies for a power supply means, which likewise is not illustrated in the drawing for reasons of clarity.

Figure 6:
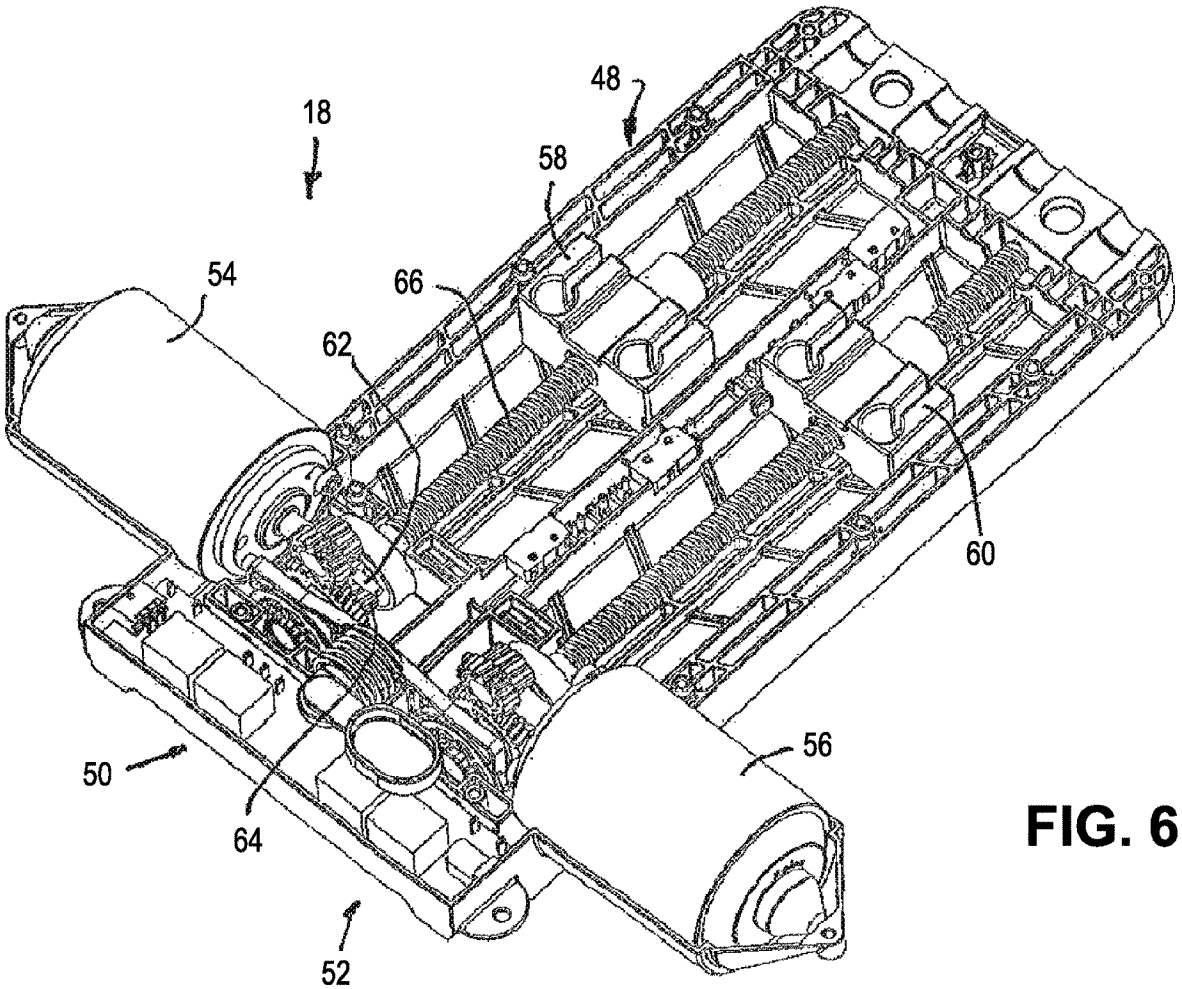
FIG. 6 shows, in the same manner as FIG. 5, the drive unit according to FIG. 5, but in enlarged scale.

FIG. 6 shows the drive unit 18 according to FIG. 5, with the Bowden cables 44, 44 and 46, 46' omitted for reasons of clarity. The drive train 50 and its mode of operation are explained in greater detail below. The drive train 52 has a corresponding construction, and therefore is not explained in greater detail.

The electric motor 54 of the drive train 50 has an output shaft 62, designed as a worm gear of a worm drive, which is in engagement with a worm gear wheel 64 that is connected in a rotationally fixed manner to a threaded spindle 66 rotatably supported in the housing 48. In the illustrated embodiment, the worm gear 62 and the worm gear wheel 64 are components of a gear assembly, which, as is apparent from FIG. 6, has even further gear elements which, however, are not of further interest in the present context and therefore are not explained in greater detail.

The spindle nut 58 to which the Bowden cables 44, 44' (not illustrated in FIG. 6) are fixed is situated on the threaded spindle 66 in a rotationally fixed manner and is movable in the axial direction. For adjusting a support part, the electric motor 54 drives the threaded spindle 66 in such a way that the spindle nut 58 moves to the left in FIG. 6, so that the spindle nut 58 tightens onto the pull cables of the Bowden cables 44, 44'. As explained in greater detail below with reference to FIG. 7, the traction effect on the pull cables of the Bowden cables 44, 44' is converted into a raising movement of a raising lever which forms an adjustment element of the mounting frame 16. A return to the unadjusted position of the slatted frame (see FIG. 1) takes place with the electric motor 54 switched on, but under the weight force of the support part, optionally additionally under the load of a person lying on the slatted frame.

Figure 7A:
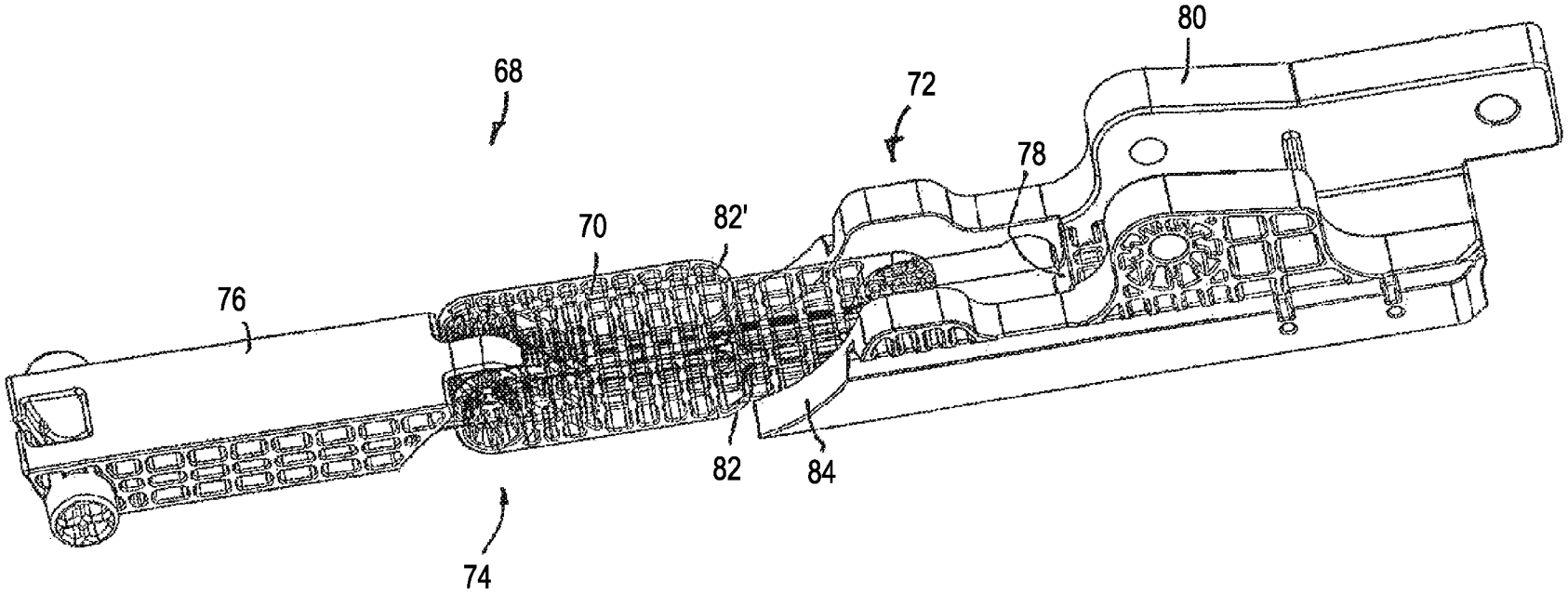
FIG. 7A shows in a perspective view details of an adjustment element of the slatted frame according to FIG. 1 in an adjustment position or kinematic phase.

FIG. 7A shows a raising lever assembly 68 which has a first raising lever 70 which forms the adjustment element of the furniture drive situated on the mounting frame 16 and which is raisable under the traction effect of the pull cable of a Bowden cable in the illustrated embodiment, under the traction effect of the pull cable of the Bowden cable 44'. The first raising lever 70 is pivotably raisable about a first pivot axis 72, the end of the first raising lever facing away from the first pivot axis 72 being articulatedly connected to a second raising lever 76 and pivotable about a second pivot axis 74 parallel to the first pivot axis 72, the second raising lever being operatively connected to the pull cable of the Bowden cable 44' in such a way that the raising levers 70, 76 rise up under the traction effect of the pull cable of the Bowden cable. In the illustrated embodiment, the pull cable of the Bowden cable, not shown in FIG. 7, is fixed to the end of the second raising lever 76 facing away from the first raising lever 70.

Figure 11A:
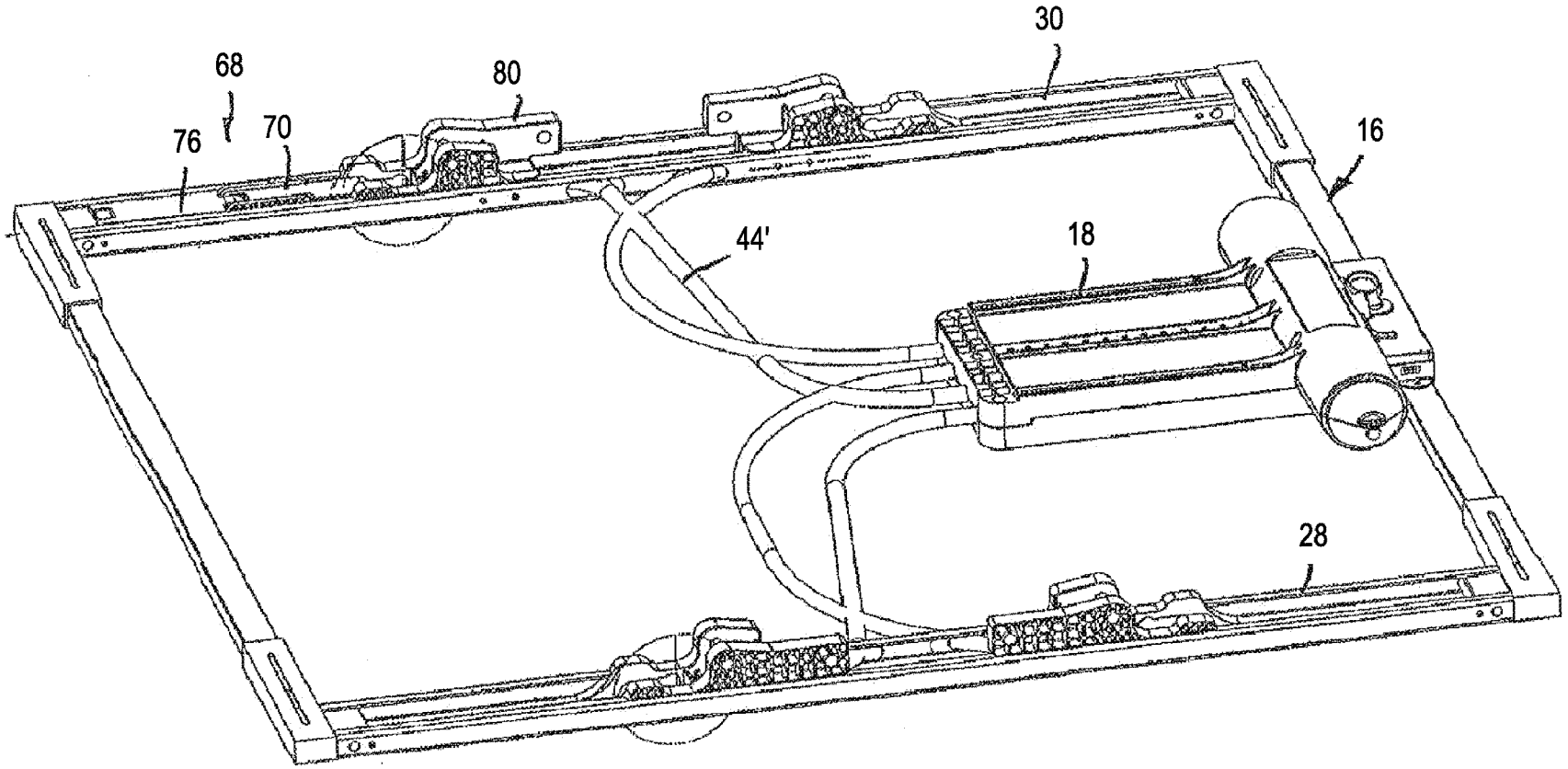
FIG. 11A shows, in a different perspective view, the mounting frame according to FIG. 3 in an adjustment position or kinematic phase.

In the illustrated embodiment, a stop 78 which is formed on a stop element 80 that is nondisplaceably connected to the longitudinal beam 30 of the mounting frame 16 is associated with the first raising lever 70 (see FIG. 11A).

The mode of operation of the raising lever assembly 68 is explained in greater detail below, with reference to FIGS. 7A to 7E and FIGS. 11A to 11E. FIGS. 7A to 7E show only the raising lever assembly 68 in combination with the stop element 80, while FIGS. 11A to 11E additionally show the mounting frame 16. In FIGS. 7A to 7E and FIGS. 11A to 11E, figures having the same letter suffix denote the same kinematic phase.

At the start of the adjustment movement, i.e., when the slatted frame 2 is unadjusted, the pivot axes 72, 74 and a force application point of the Bowden cable 44' on the second raising lever 76 lie in one plane, so that the raising lever assembly is translationally displaced to the right in FIG. 7A or 11A under the traction effect of the pull cable of the Bowden cable 74. As is apparent from FIG. 11A, the C-shaped profile of the longitudinal beam 30 of the mounting frame 16 forms a guide for the translational displacement of the raising lever assembly 68. Due to the fact that in the first kinematic phase the first pivot axis 72 and the second pivot axis 74 as well as the force application point of the pull cable of the Bowden cable 44 on the second raising lever 76 lie in one plane, in the first kinematic phase the raising lever assembly 68 is displaced to the right in FIG. 7A or FIG. 11A solely by translation.

At the end of the first kinematic phase, the first raising lever 70 together with thickened areas 82, 82' extending laterally, i.e., in the axial direction of the first pivot axis 72, runs up against a lift guide 84 formed on the stop element 80. In the illustrated embodiment, the lift guide 84 has a curved cross-sectional shape. However, it may also be designed as an inclined plane.

Figure 7B:
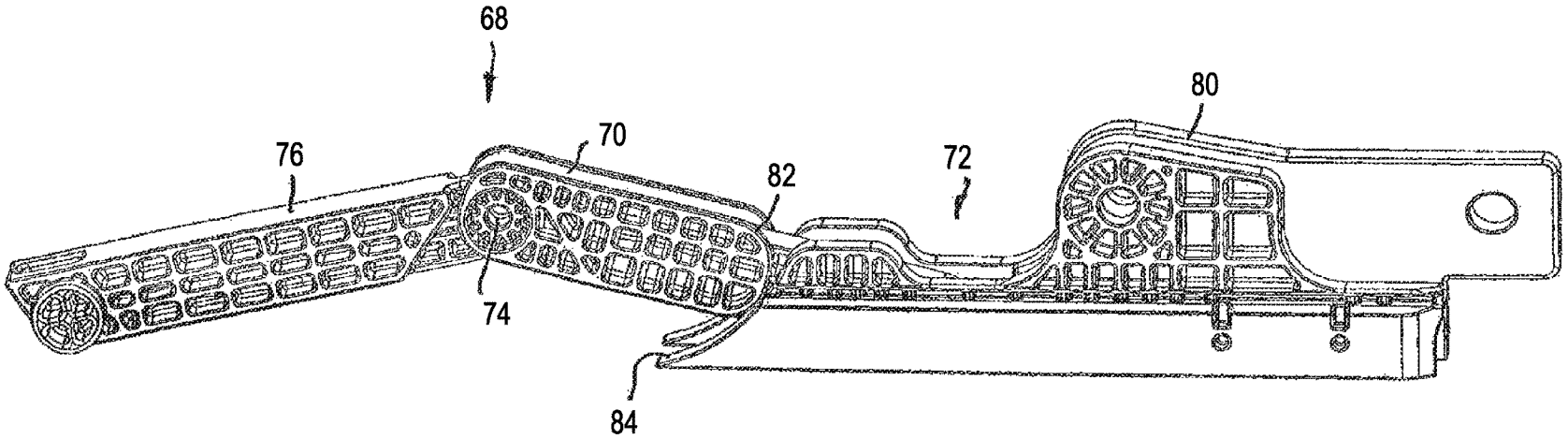
FIG. 7B shows in a perspective view details of another adjustment element of the slatted frame according to FIG. 1 in another adjustment position or kinematic phase.
Figure 11B:
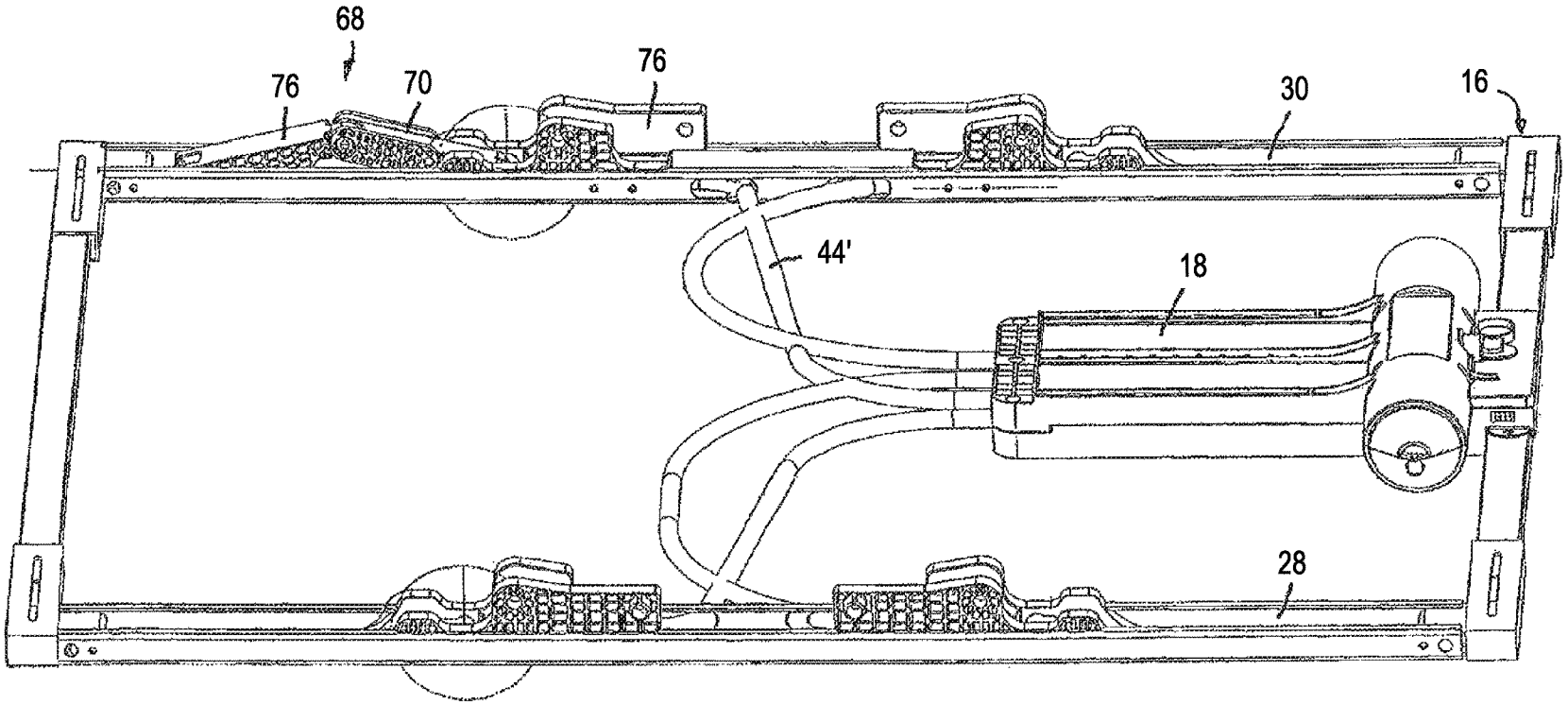
FIG. 11B shows, in a different perspective view, the mounting frame according to FIG. 3 in a different adjustment position or kinematic phase.

FIG. 7B illustrates how the end of the first raising lever 70 facing away from the second raising lever 76 runs up against the lift guide 84 and is thus raised, which under the traction effect of the pull cable of the Bowden cable 44' causes the raising levers 70, 76 to rise up. FIG. 11B illustrates the resulting raising of the raising levers 70, 76. As is apparent from FIG. 7B and FIG. 11B, during the second kinematic phase the raising lever assembly 68 simultaneously undergoes a translational movement as well as a raising movement.

Figure 7C:
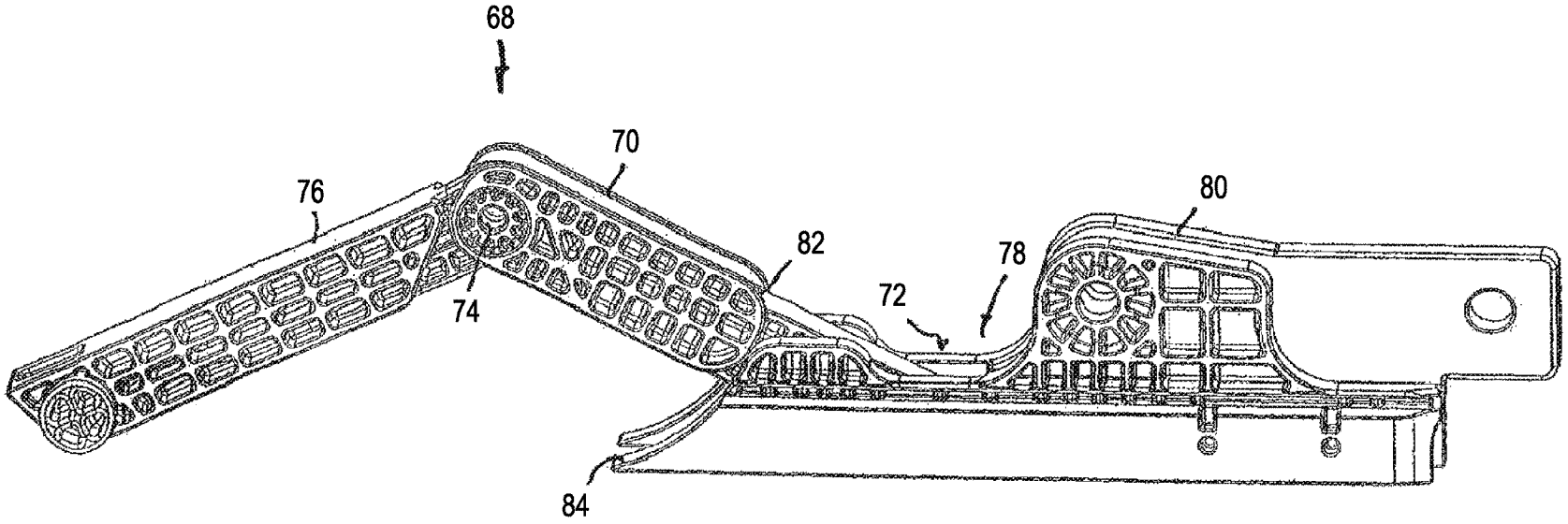
FIG. 7C shows in a perspective view details of another adjustment element of the slatted frame according to FIG. 1 in another adjustment position or kinematic phase.
Figure 11C:
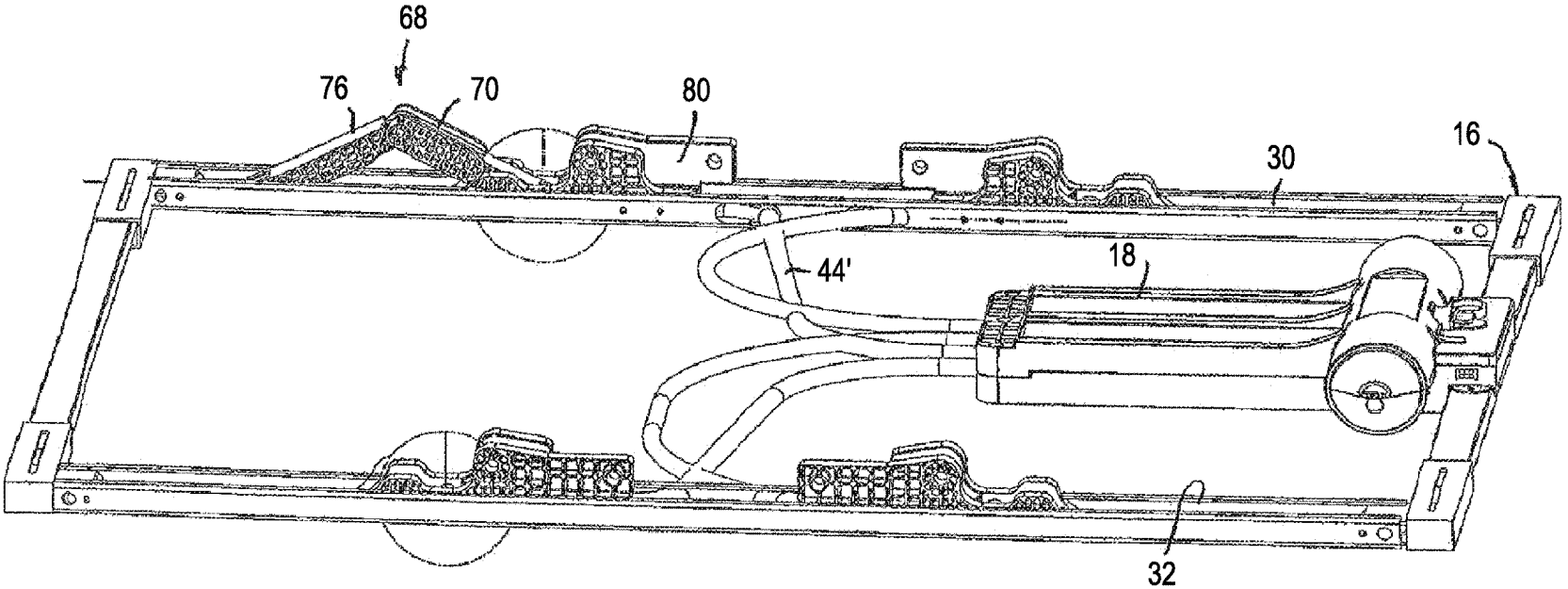
FIG. 11C shows, in a different perspective view, the mounting frame according to FIG. 3 in a different adjustment position or kinematic phase.

FIG. 7C and FIG. 11C illustrate the end of the second kinematic phase, in which the free end of the first raising lever 70 facing away from the second raising lever 76 runs up against the stop 78 formed by the stop element 80, so that further translational movement of the raising lever assembly 68 is prevented.

During a subsequent third kinematic phase, the first raising lever 70 undergoes only a raising movement in which it pivots about the first pivot axis 72.

Figure 7D:
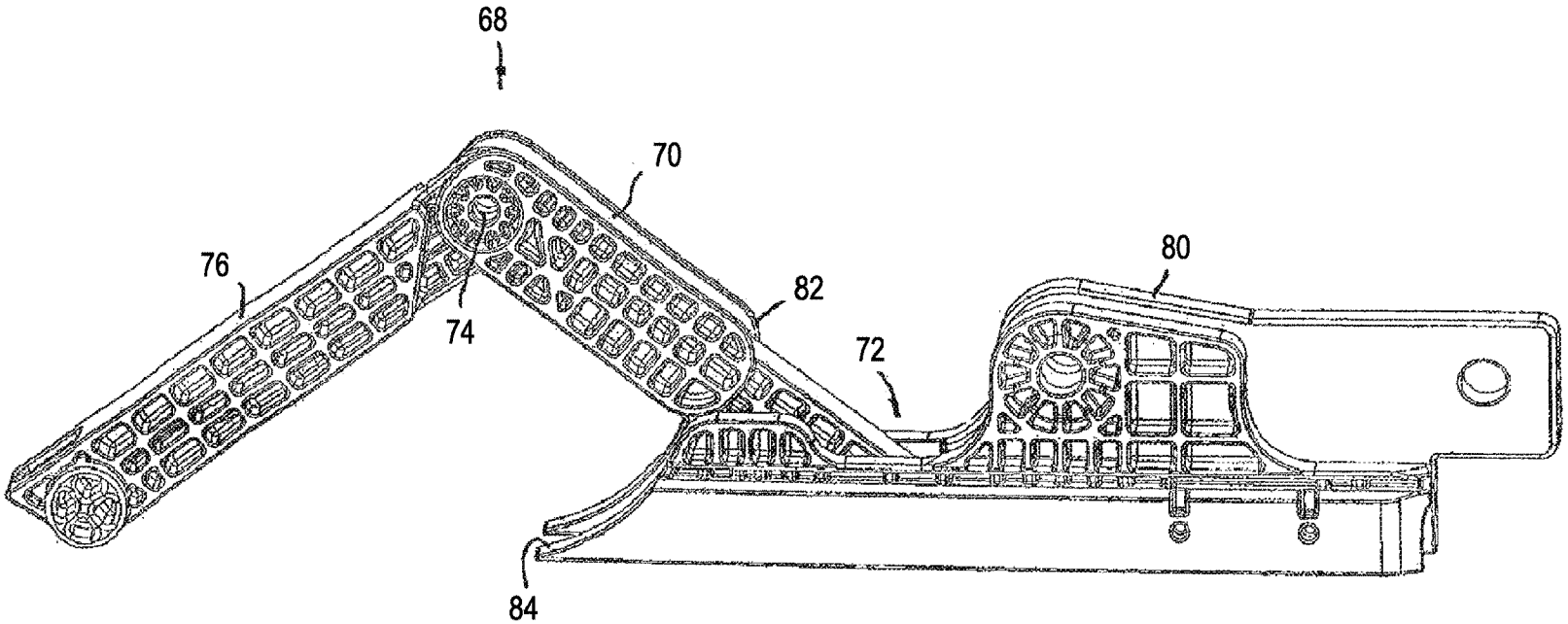
FIG. 7D shows in a perspective view details of another adjustment element of the slatted frame according to FIG. 1 in another adjustment position or kinematic phase.
Figure 11D:
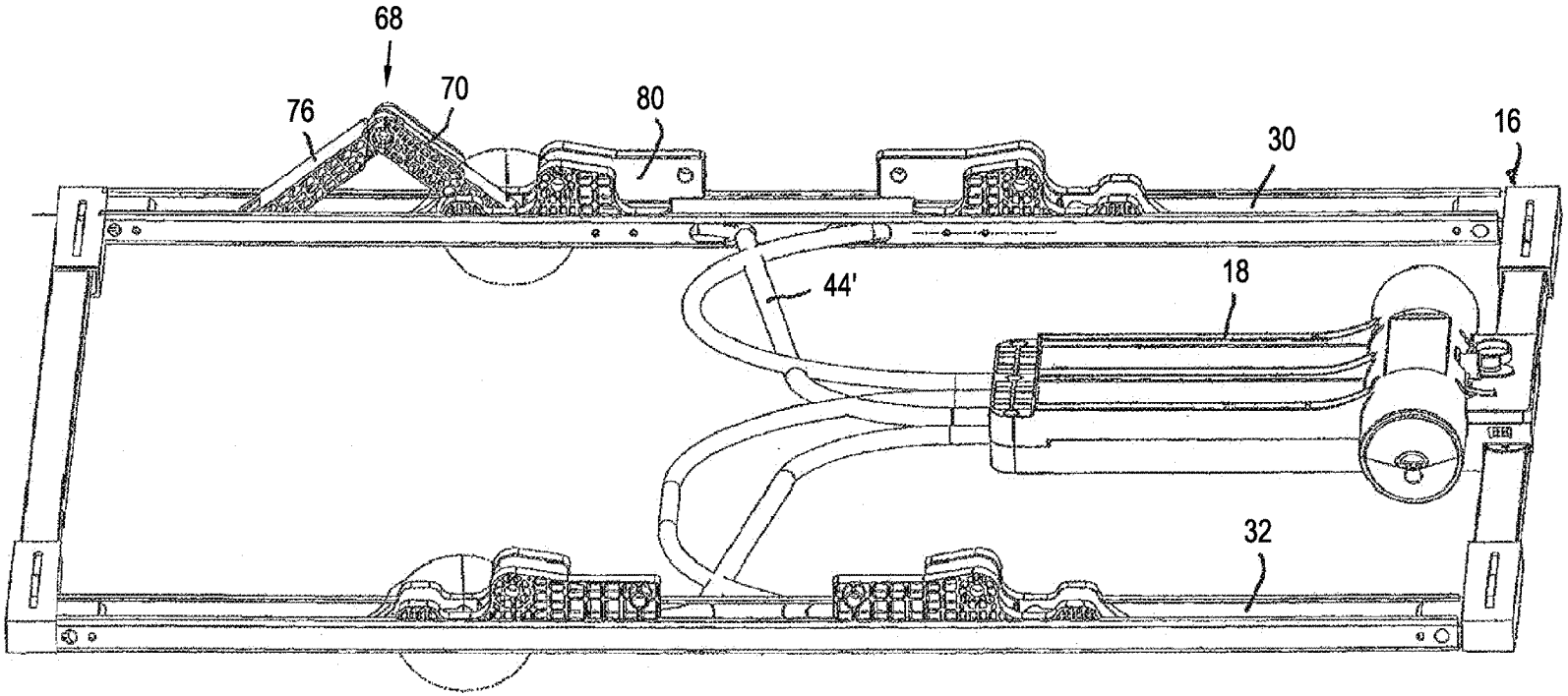
FIG. 11D shows, in a different perspective view, the mounting frame according to FIG. 3 in a different adjustment position or kinematic phase.

FIGS. 7D and 11D illustrate the raising lever assembly 68 in the third kinematic phase.

Figure 7E:
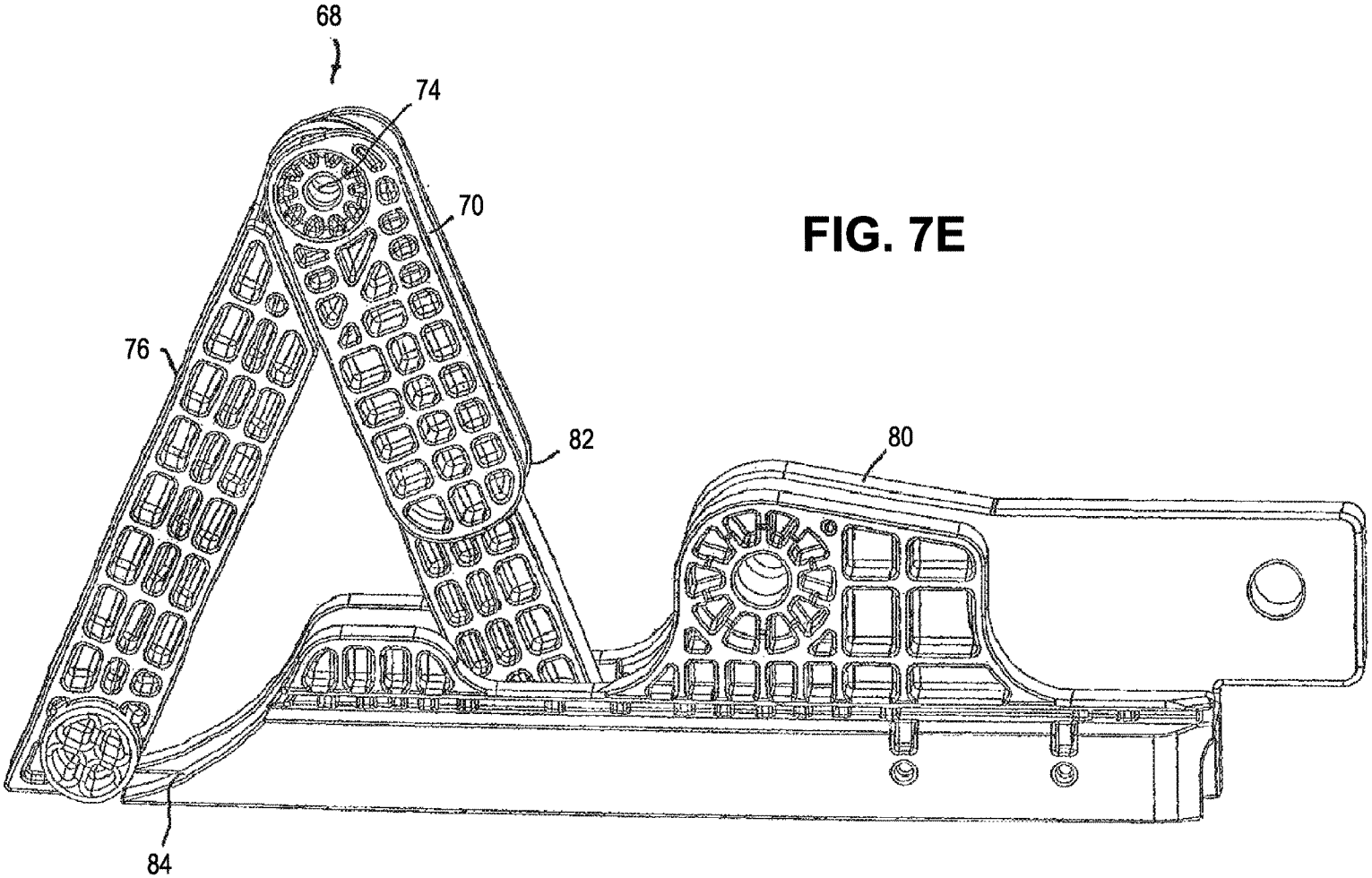
FIG. 7E shows in a perspective view details of another adjustment element of the slatted frame according to FIG. 1 in another adjustment position or kinematic phase.
Figure 11E:
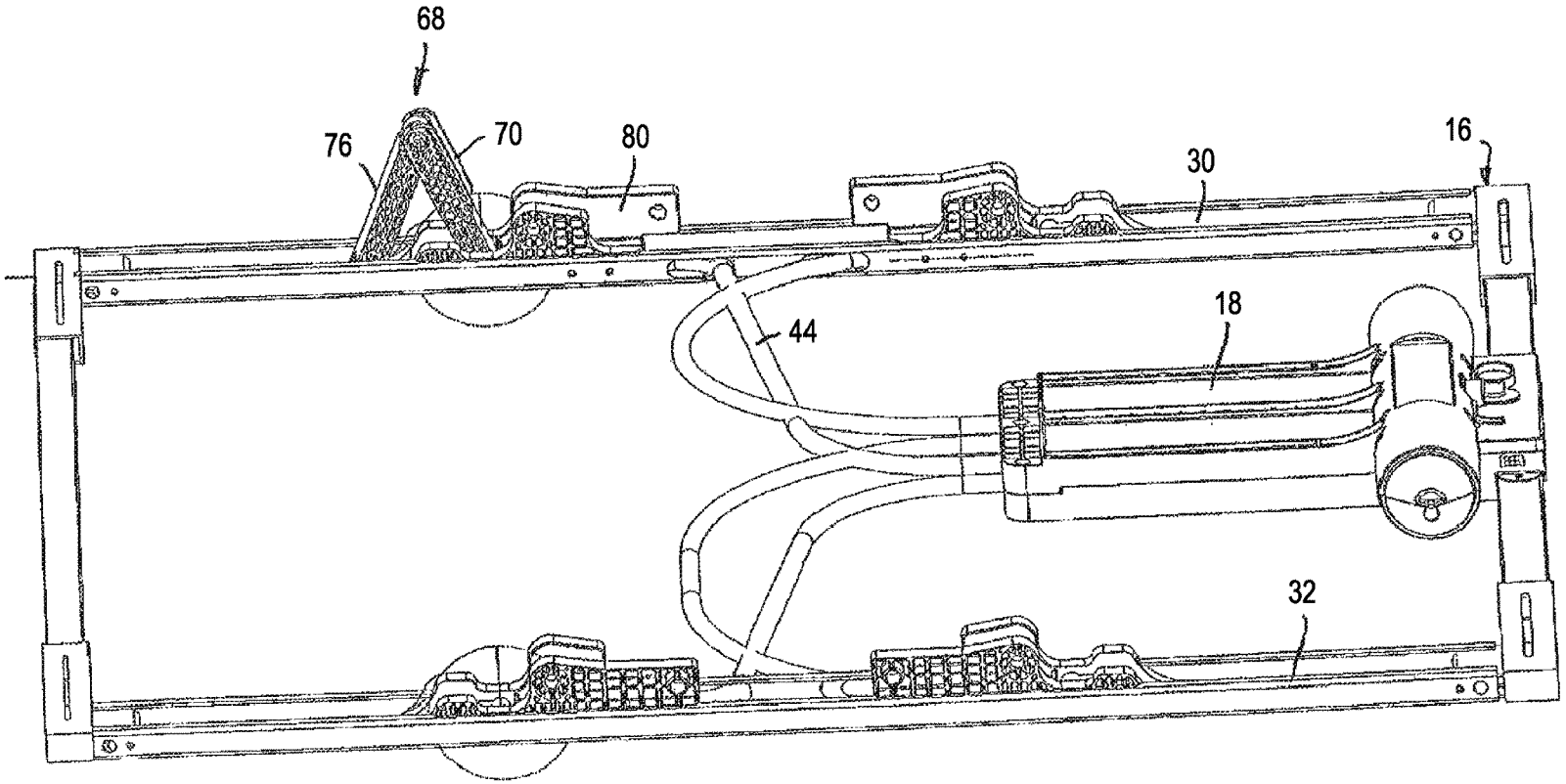
FIG. 11E shows, in a different perspective view, the mounting frame according to FIG. 3 in a different adjustment position or kinematic phase.

FIG. 7E and FIG. 11E show the raising lever assembly 68 at the end of the third kinematic phase, in which the raising levers 70, 76 of the raising lever assembly 68 are maximally raised. The position of the raising lever assembly 68 illustrated in FIG. 7E and FIG. 11E corresponds to a maximum adjustment of the upper body support part 8 relative to the center support part 6.

Figure 8:
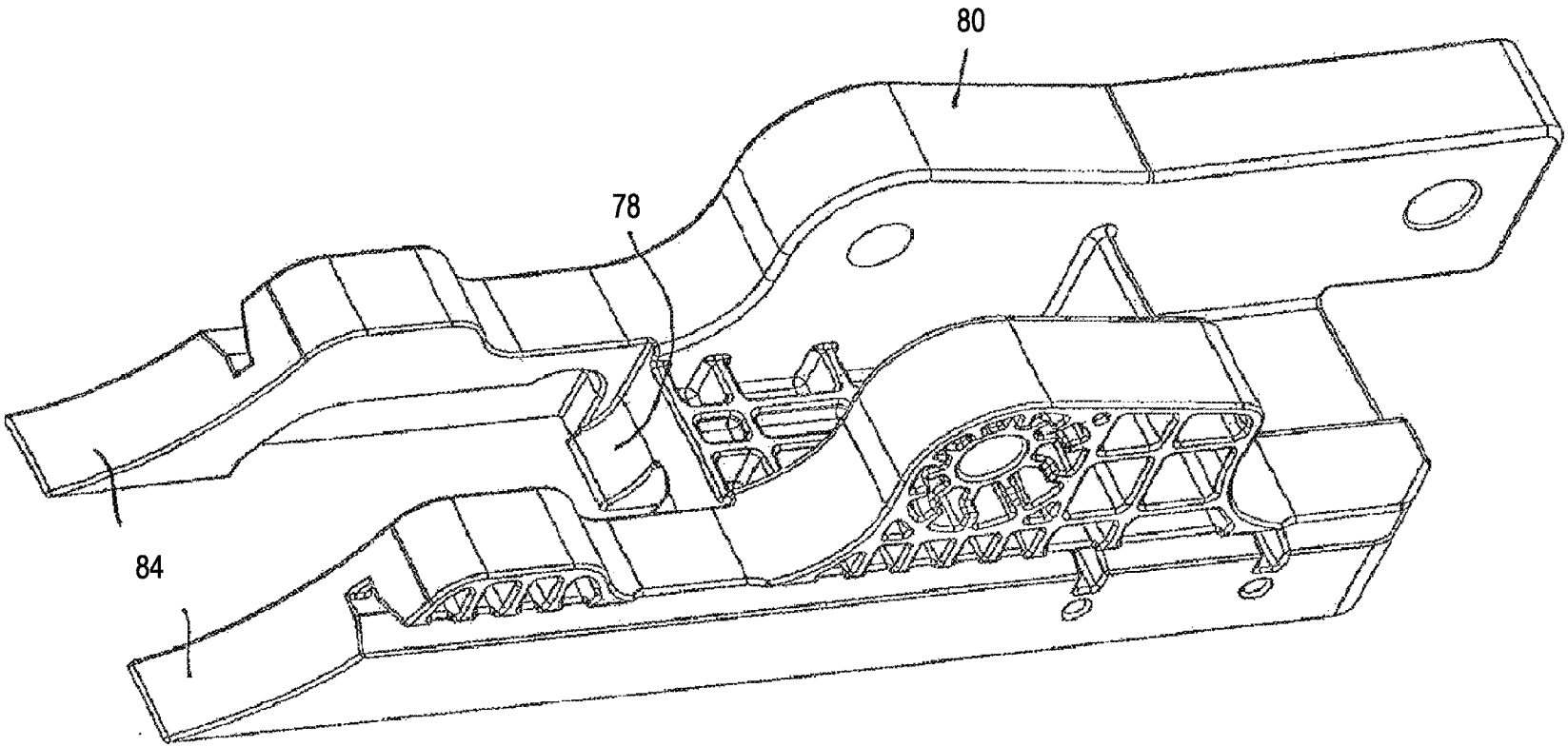
FIG. 8 shows, in a perspective view and in enlarged scale compared to FIG. 7, a stop element of the slatted frame according to FIG. 1.

FIG. 8 shows a perspective view of the stop element 80 by itself, in which the stop 78 is particularly well discernible.

Figure 9:
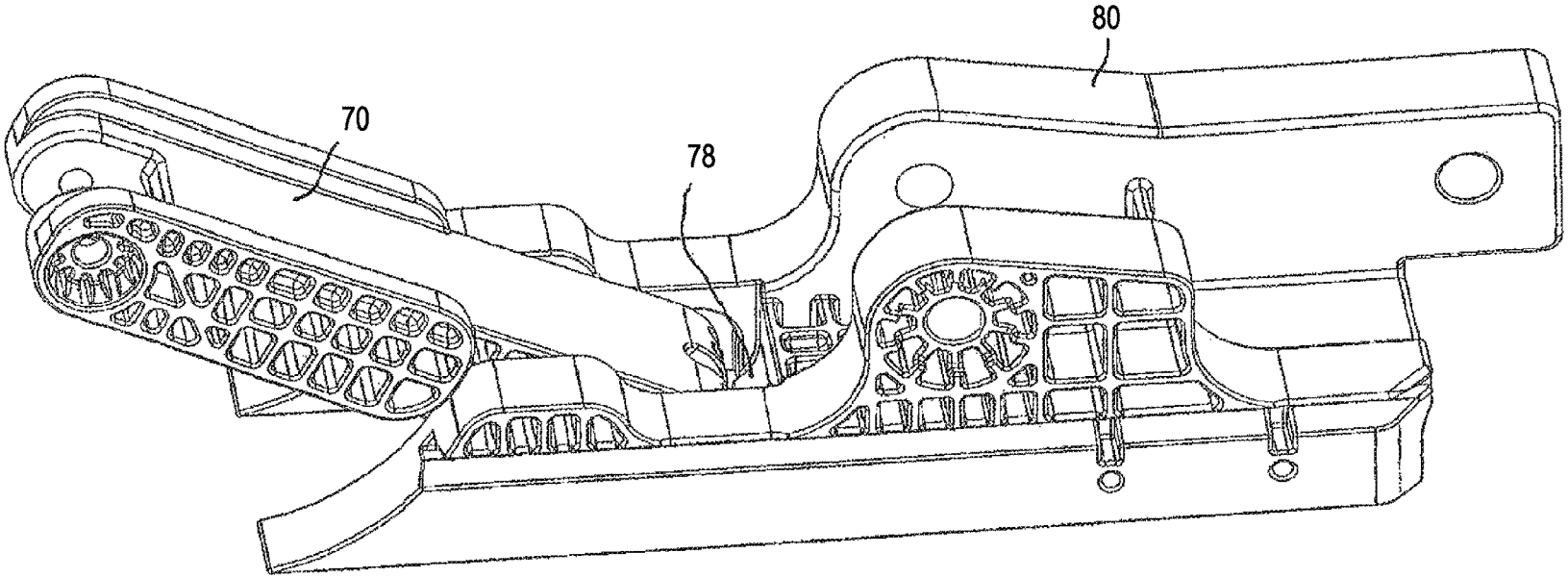
FIG. 9 shows, in the same manner as FIG. 8, the stop element according to FIG. 8 in combination with a raising lever.

FIG. 9 illustrates the free end of the first raising lever 70 running up against the stop 78 at the end of the second kinematic phase.

Figure 10:
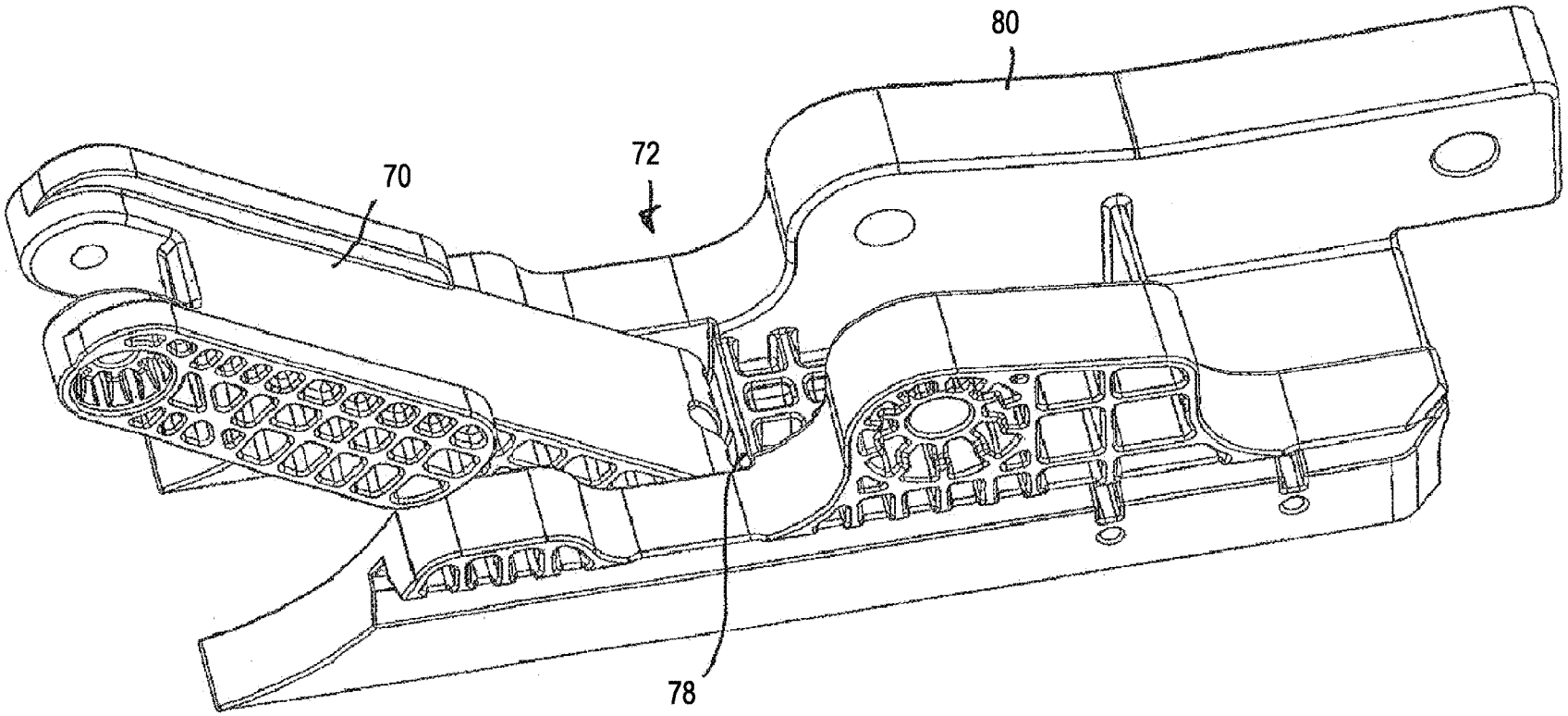
FIG. 10 shows, in the same manner as FIG. 9, the stop element and the raising lever according to FIG. 9 in a different kinematic phase.

FIG. 10 shows the first raising lever 70 during the third kinematic phase, in which it undergoes only a pivoting movement about the first pivot axis 72, and in the process rests against the stop 78.

FIG. 12 illustrates the adjustment of the upper body support part 8 by means of the raising lever assembly 68. In the illustrated embodiment, the raising lever assembly 68 acts loosely on a longitudinal beam 86 of the upper body support part 8, in that the longitudinal beam 86 rests loosely on the raising lever assembly 68. At a lateral distance from the longitudinal beam 86, the upper body support part 8 has a further longitudinal beam 88 with which a corresponding raising lever assembly (not illustrated in FIG. 12 for reasons of clarity) is associated. The raising lever assembly associated with the longitudinal beam 88 cooperates with the pull cable of the Bowden cable 44; the mode of operation is the same as described for the raising lever assembly 68, and therefore is not explained here in greater detail. Since the pull cables of the Bowden cables 44, 44' are fixed to the same spindle nut 58 (see FIG. 5), the raising lever assemblies associated with the longitudinal beams 68, 88 rise up fully synchronously, so that distortions of the upper body support part 8 during the adjustment movement are reliably avoided.

Figure 12A:
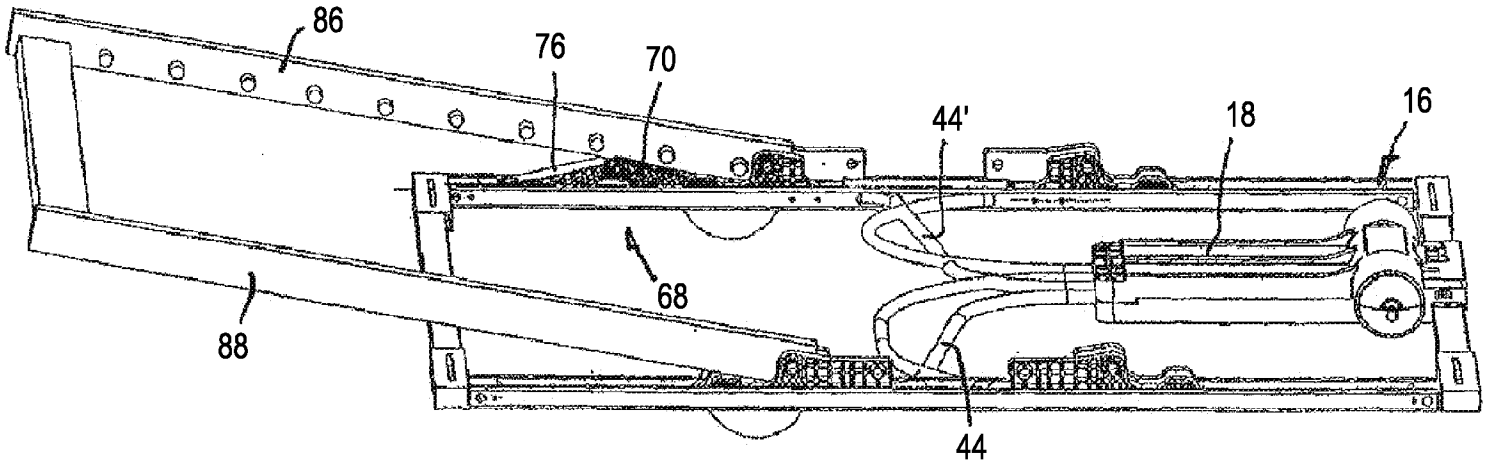
FIG. 12A shows, in the same manner as FIG. 11 but in slightly reduced scale, the mounting frame according to FIG. 3 in an adjustment position or kinematic phase in combination with a support part to be adjusted.
Figure 12B:
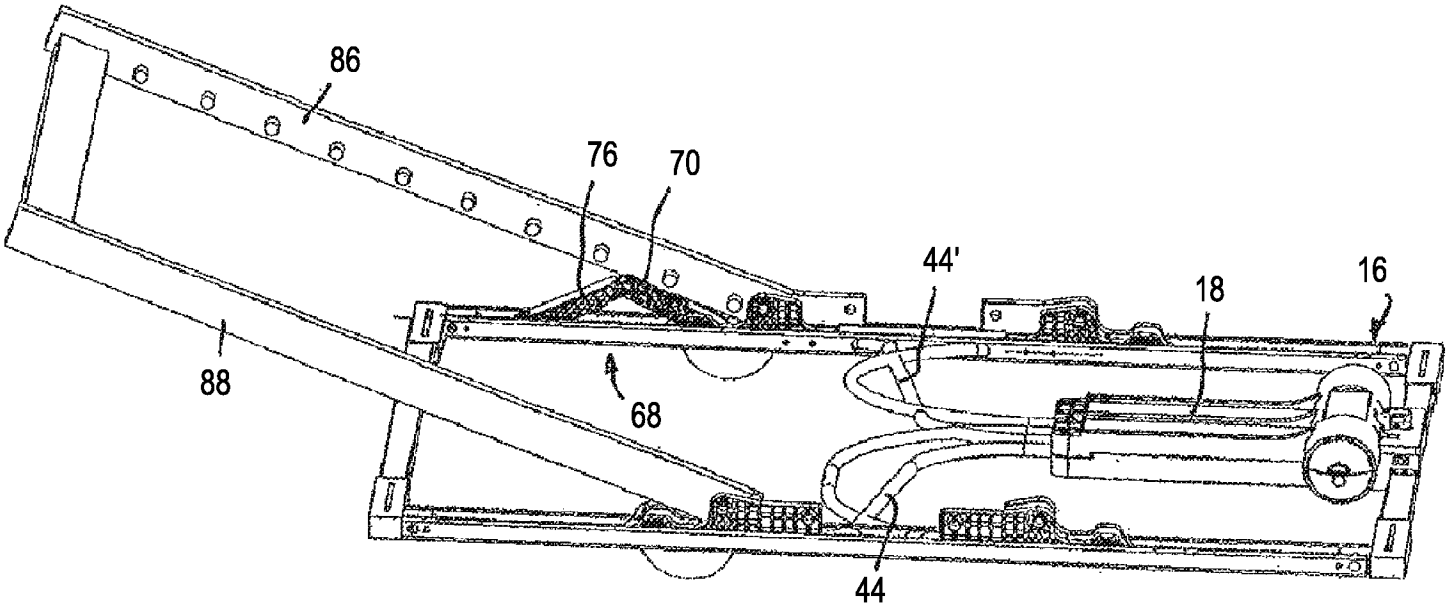
FIG. 12B shows, in the same manner as FIG. 11 but in slightly reduced scale, the mounting frame according to FIG. 3 in a different adjustment position or kinematic phase in combination with a support part to be adjusted.
Figure 12C:
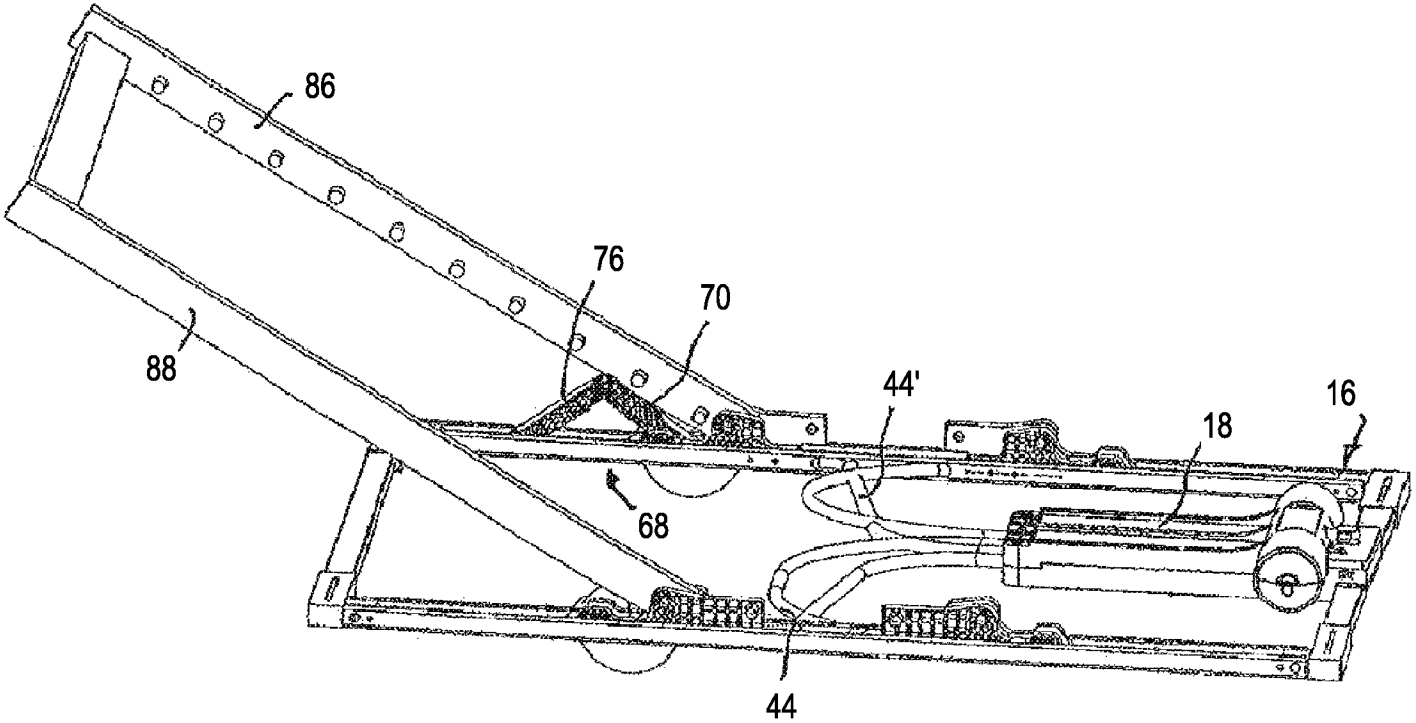
FIG. 12C shows, in the same manner as FIG. 11 but in slightly reduced scale, the mounting frame according to FIG. 3 in a different adjustment position or kinematic phase in combination with a support part to be adjusted.
Figure 12D:
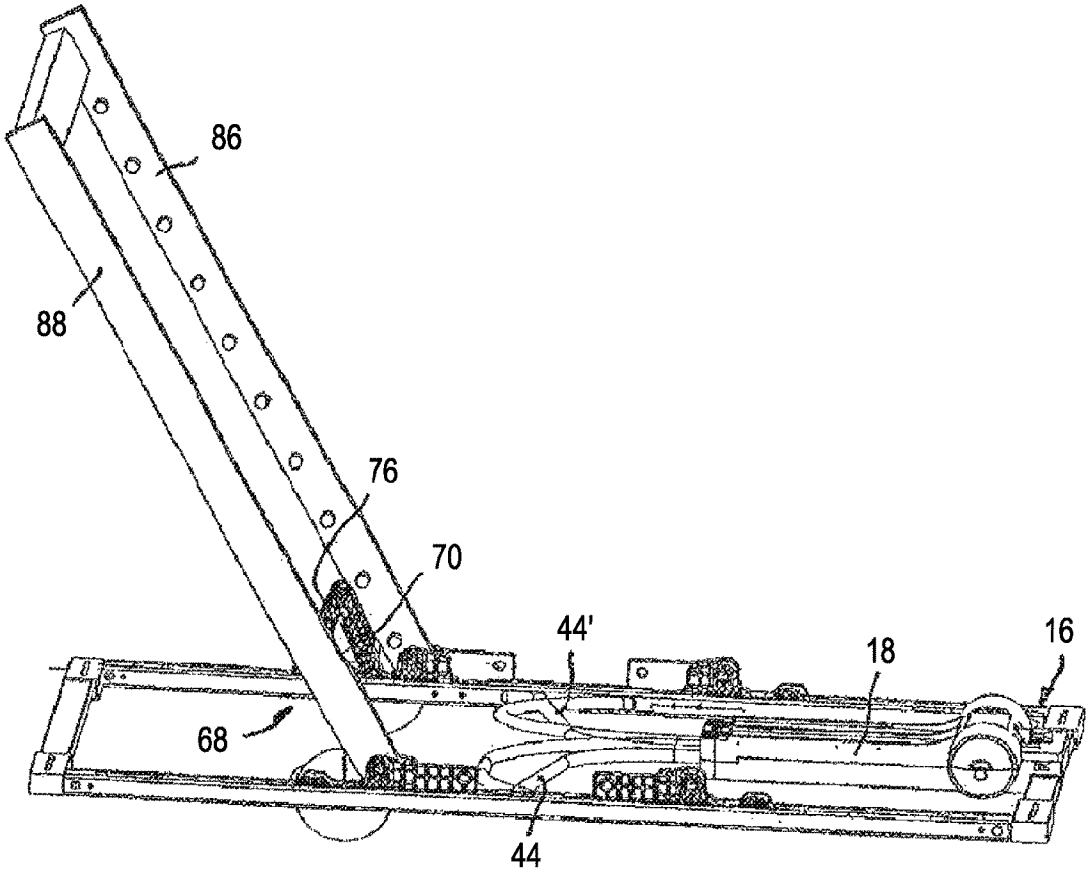
FIG. 12D shows, in the same manner as FIG. 11 but in slightly reduced scale, the mounting frame according to FIG. 3 in a different adjustment position or kinematic phase in combination with a support part to be adjusted.

FIGS. 12B and 12C illustrate the further adjustment movement of the upper body support part 8. FIG. 12D shows the end position of the adjustment movement, which corresponds to a maximally adjusted position of the upper body support part 8 relative to the center support part or the mounting frame 16.

Figure 13:
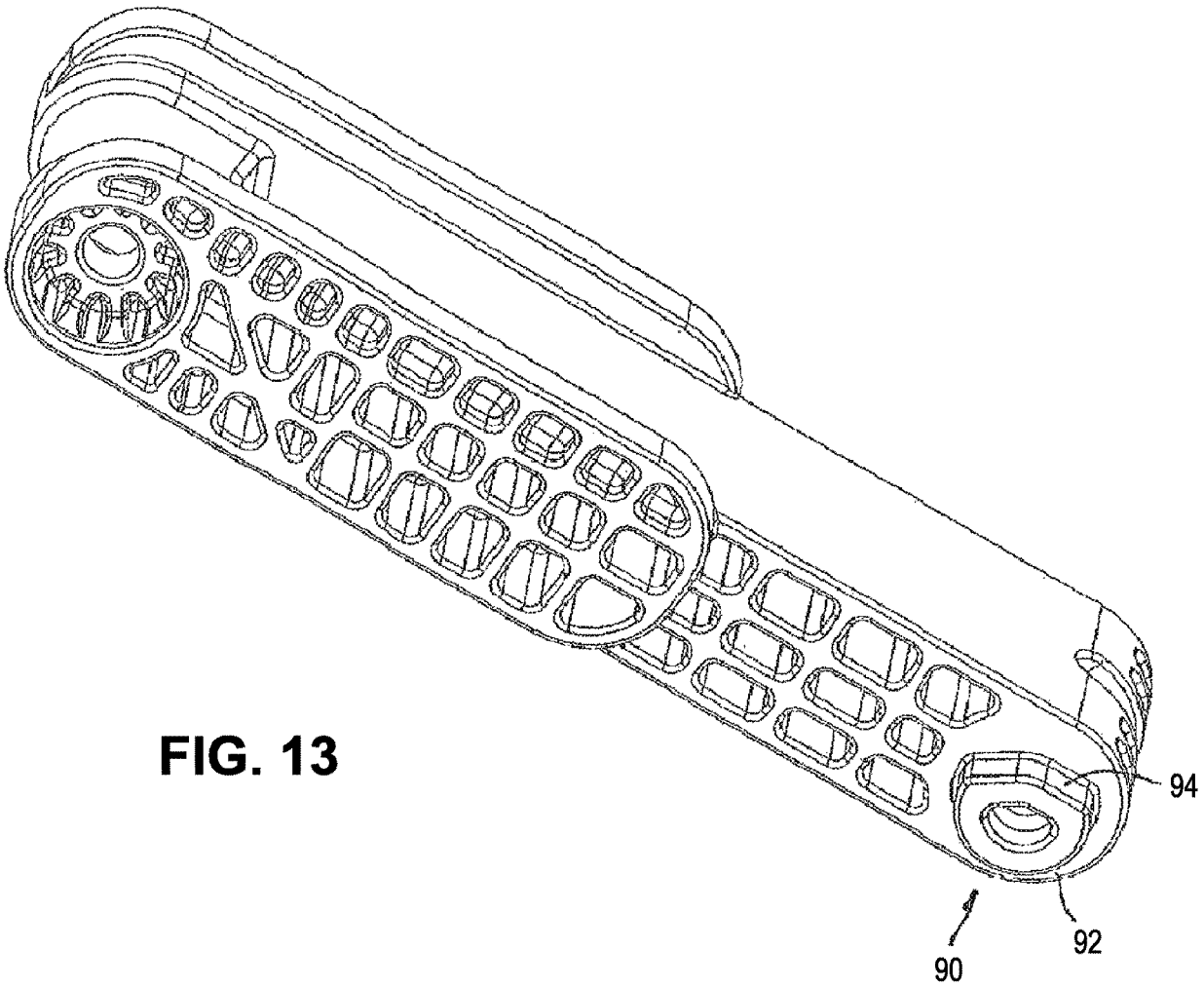
FIG. 13 shows in a perspective illustration the first raising lever by itself.
Figure 14:
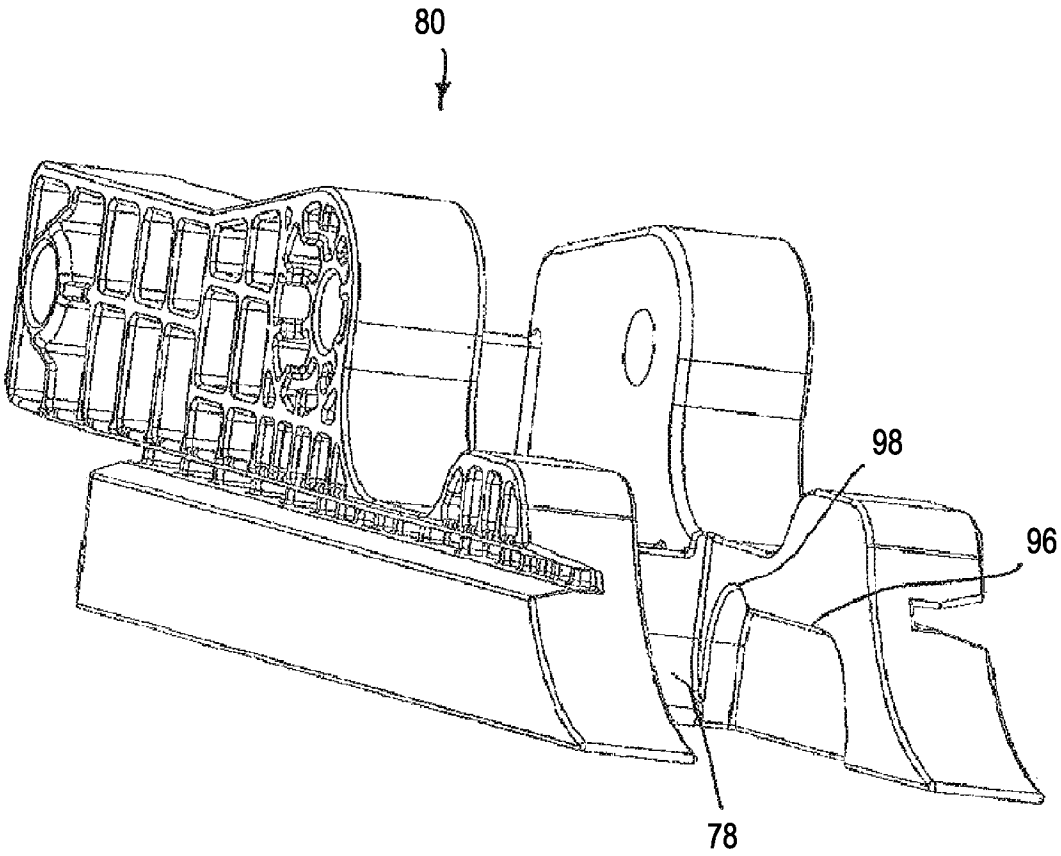
FIG. 14 shows in a perspective illustration the stop element by itself.

The locking means associated with the first raising lever 70 is explained in greater detail below with reference to FIGS. 13 and 14; FIG. 13 shows the first raising lever 70 and FIG. 14 shows the stop element 18 by itself. A locking means is associated with the first raising lever 70, and becomes operative in a predetermined raised position of the first raising lever and blocks the first raising lever 70 from undergoing a translational movement, and at the same time allows a raising movement of the first raising lever. In the illustrated embodiment, the locking means becomes operative when the first raising lever 70, resting against the stop 78 and pivoting, reaches a predetermined raised position. In the illustrated embodiment, the locking means has a bearing journal 90 (see FIG. 13) which is formed on the end of the first raising lever 70 facing the first pivot axis 72. The bearing journal 90 is designed and configured in such a way that in the locked position it is rotatably and pivotably supported in a bearing receptacle formed on the stop element 80, and in an unlocked position is released from the bearing receptacle.

As is apparent from FIG. 13, the bearing journal 90 has a bearing section 92 with a circular cross section, and a flattened area 94. As a result, in the illustrated embodiment the bearing section 92 has an approximately semicircular cross section. It is not apparent from FIG. 13, and therefore not discussed here, that the first raising lever 70 has a corresponding bearing journal on its side facing away from the bearing journal 90.

FIG. 14 shows a perspective view of the stop element 80. The stop element 80 has a groove 96, which at its end opens into a bearing surface section 98 which has a circular cross section in portions and whose diameter is greater than the inside width of the groove 96.

The mode of operation of the locking means is as follows:

As described above with reference to FIG. 7B, during the adjustment movement the end of the first raising lever 70 facing away from the second raising lever 76 runs up against the lift guide 84 and is thus lifted, resulting in raising of the raising levers 70, 76. In the process, the bearing journal 90 is translationally led in the guide formed by the groove 96. The dimensions of the inside width of the groove 96 are such that, taking the shape of the bearing journal 90 and the raising angle of the first raising lever 70 into account, the bearing journal 90 is translationally led in the guide formed by the groove 96 without jamming.

At the end of the second kinematic phase (see the above description with reference to FIG. 7C and FIG. 11C), the free end of the first raising lever 70 facing away from the second raising lever 76 runs up against the stop 78 formed on the stop element 80 in such a way that further translational movement of the raising lever assembly 86 is prevented.

During the subsequent third kinematic phase, the first raising lever 70 undergoes only a raising movement by pivoting about the first pivot axis 72. Due to the shape of the bearing journal 90 and of the bearing receptacle 98, upon further raising of the first raising lever 70 the bearing journal 92 locks onto the bearing receptacle 98 in such a way that the bearing journal is secured against translational movement, and at the same time, a further raising movement of the first raising lever 70 is allowed.

The locking means ensures that the raising lever assembly 68 uniformly lowers in the direction of the unadjusted position during a return from a maximally adjusted position. The return is completed in such a way that the first raising lever 70 pivots back in the direction of the unadjusted position. Up to a certain raised position of the first raising lever 70, the locking means allows only a rotational or pivoting motion. In a predetermined raised position the locking is discontinued, so that the bearing journal 90 subsequently moves translationally in the groove 96, in the direction facing away from the stop 78.

Without the locking means, there would be a risk that during a return, the first raising lever would immediately move translationally, resulting in sudden dropping, which is undesirable.

Figure 15:
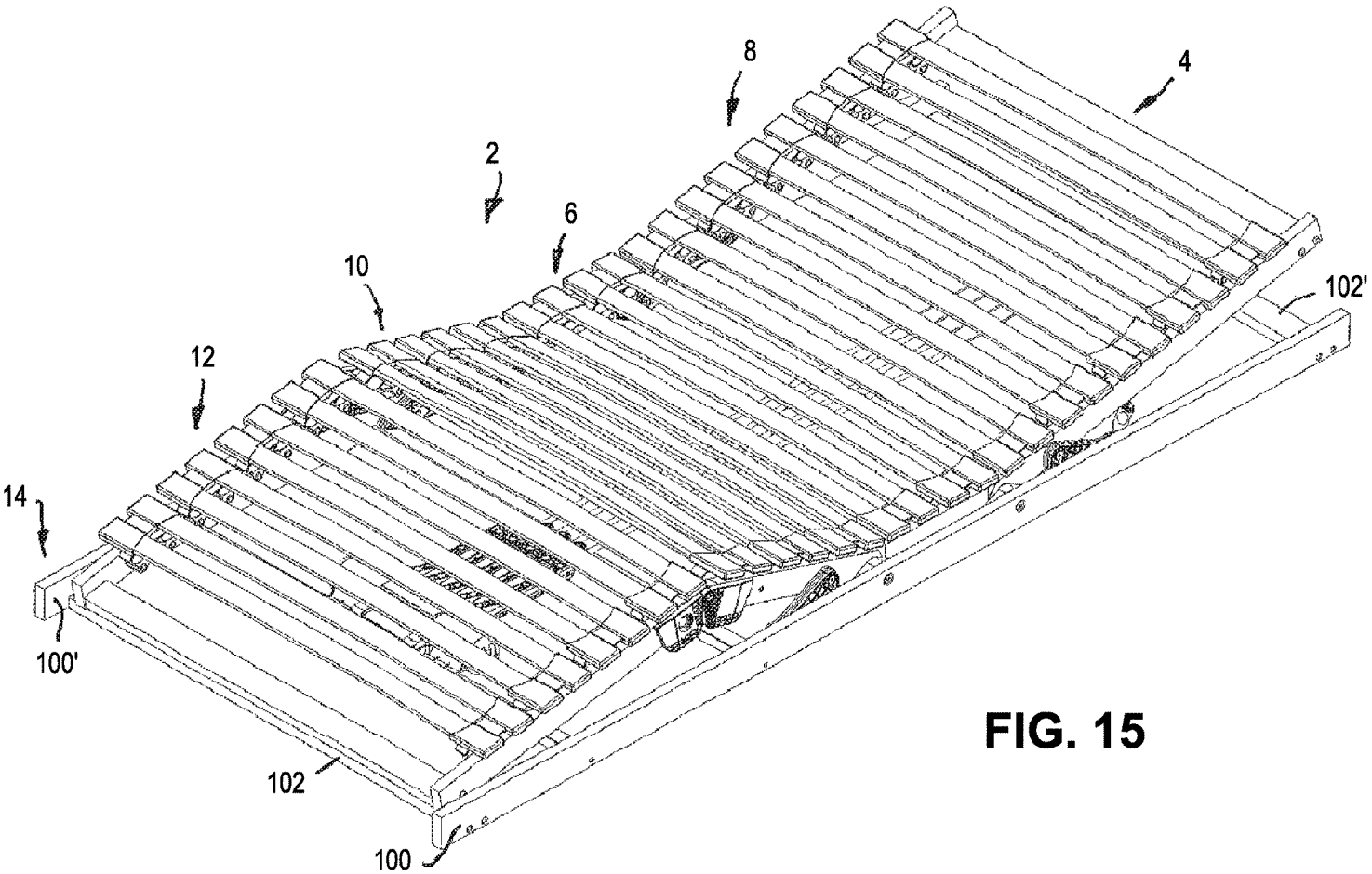
FIG. 15 shows in a perspective illustration one embodiment of a support apparatus according to the invention in the form of a slatted frame, with support parts of the support apparatus slightly adjusted with respect to an unadjusted starting position.
Figure 16:
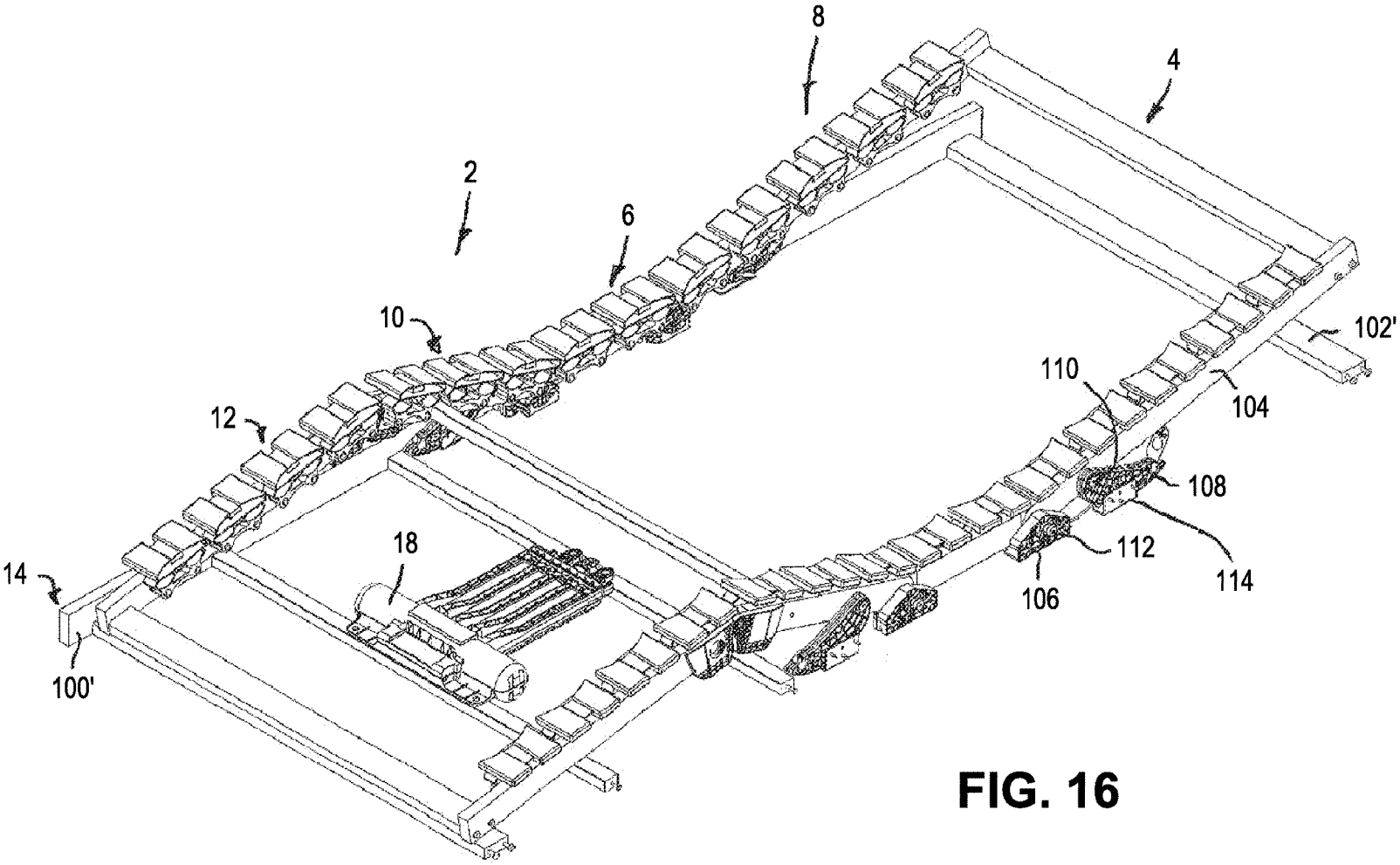
FIG. 16 shows, in the same manner as FIG. 15, the support apparatus according to FIG. 15 with slats of the support apparatus and a longitudinal beam of an outer frame omitted for purposes of illustration.
Figure 17:
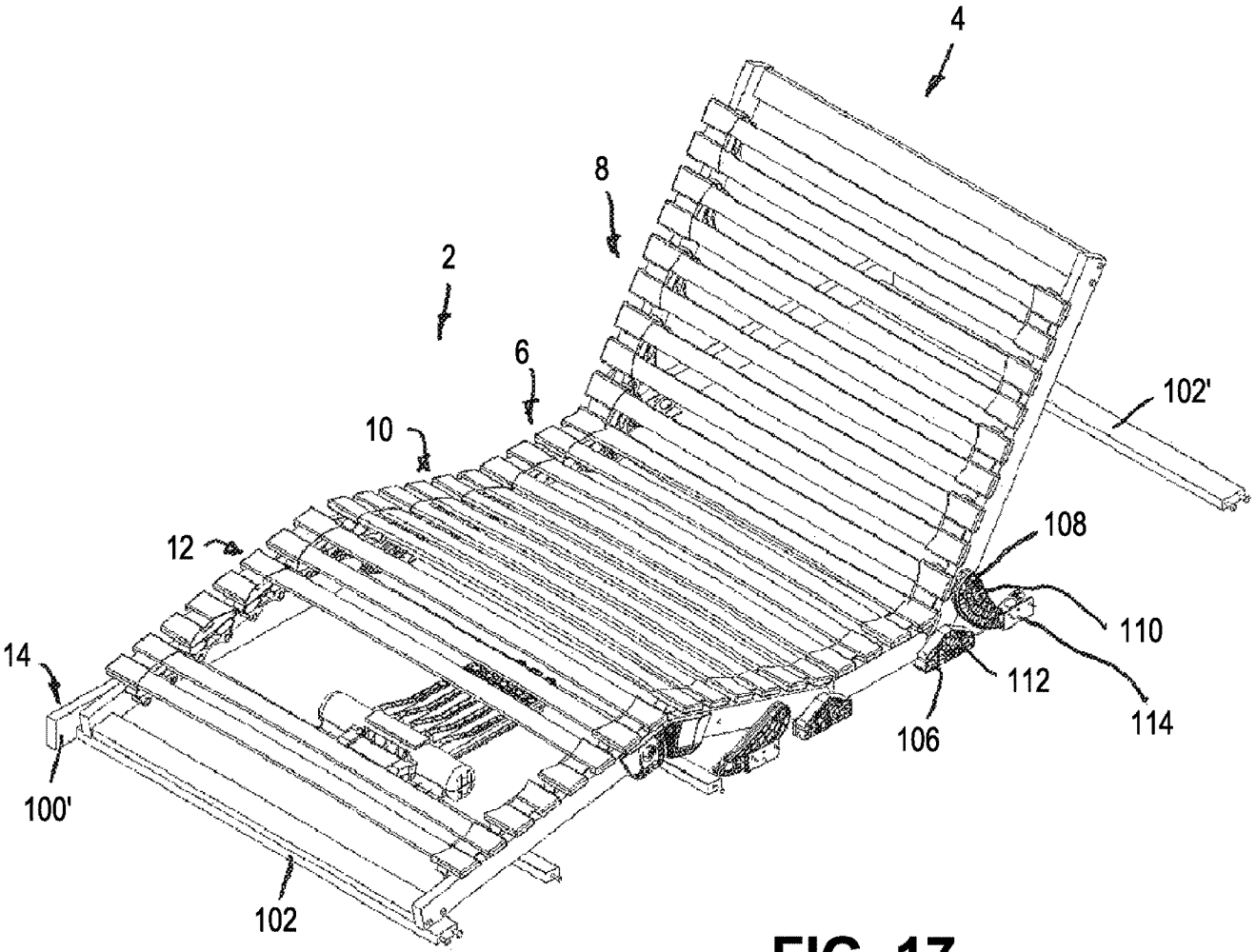
FIG. 17 shows, in the same manner as FIG. 15, the support apparatus according to FIG. 15 in a maximally adjusted end position of the adjustment movement with respect to the starting position.

Reference is made to FIGS. 15 to 17 below for explaining one embodiment of a support apparatus according to the invention.

FIG. 15 shows the support apparatus 2 in an adjustment position in which the support parts 8, 10, 12 are slightly adjusted with respect to an unadjusted starting position in which they, together with the center support part 6, span an essentially horizontal support plane.

It is apparent from FIG. 15 that the outer frame 14 has two mutually parallel longitudinal beams 100, 100' which are connected to one another via transverse beams 102, 102'.

FIG. 16 shows the support apparatus 2 according to FIG. 15, with the longitudinal beam 100 and elastic slats, which are connected to the support parts 6, 8, 10, 12 and on which padding, for example a mattress of a bed, is supported when the support apparatus 2 is used, omitted for purposes of illustration.

The adjustment of the upper body support part 8 relative to the center support part 6 is explained in greater detail below. The adjustment of the leg support part 10 together with the calf support part 12 relative to the center support part 6 takes place in a corresponding manner, and therefore is not explained in greater detail. The support apparatus 2 has a mirror image design with respect to its longitudinal center plane. Only the portion in FIG. 16 situated closer to the viewer is explained below. The portion situated farther from the viewer has a corresponding design, and therefore is not explained in greater detail.

A longitudinal beam 104 of the upper body support part 8 is pivotably supported on the longitudinal beam 104 on a pivot bearing 106 which is fastened to the longitudinal beam 100, not illustrated in FIG. 16. For the pivot adjustment of the upper body support part 8 relative to the outer frame 14, and thus relative to the center support part 6, an adjustment element is associated with the upper body support part 8, the adjustment element according to the invention being a pivot lever 108 which is pivotable under the traction effect of a pull cable of a Bowden cable. The pivot lever 108 is connected to the longitudinal beam 104 of the upper body support part 8 so as to be pivotable about a pivot axis 110 which is situated eccentrically with respect to a pivot axis 112 of the pivot bearing 106.

In the illustrated embodiment, the pivot lever 108 is supported at a distance from the pivot axis 110 on a support, which in this embodiment is formed on an angle bracket 114. A vertical leg of the angle bracket 114 is connected, for example screwed, to the longitudinal beam 100 (not illustrated in FIG. 16), while a horizontal leg of the angle bracket 114 forms the support on which the pivot lever 108 is supported. A pull cable of a Bowden cable, not illustrated in FIG. 16 for reasons of clarity, is fixed to the end of the pivot lever facing away from the pivot axis 110. The pull cable of the Bowden cable is guided by the pivot lever 108 to the drive unit 18. The manner in which a pivot lever is adjusted by means of the drive unit 18 under the traction effect of a Bowden cable has already been explained above with reference to FIGS. 1 to 14.

For adjusting the upper body support part 8, the drive unit 18 exerts a tensile force on the pull cable of the Bowden cable in such a way that the pivot lever 108, which in this embodiment is designed as a raising lever, pivots clockwise about the pivot axis 110 relative to the upper body support part 8 under the traction effect of the pull cable of the Bowden cable, and in the process rises up. During the raising movement, the pivot lever 108 is supported on the support formed on the angle bracket 114. From a comparison of FIGS. 16 and 17 it is apparent that, during the pivoting of the pivot lever 108, the upper body support part 8 pivots about its pivot axis 112 relative to the outer frame 14 until the end position of the adjustment movement illustrated in FIG. 17 is reached.

From a comparison of FIGS. 15 to 17 it is apparent that the components necessary for the electromotive adjustment of the support parts of the support apparatus have a small installation height and a simple design.

Reference is made below to FIGS. 18 to 21 for explaining another embodiment of a support apparatus according to the invention.

Figure 18:
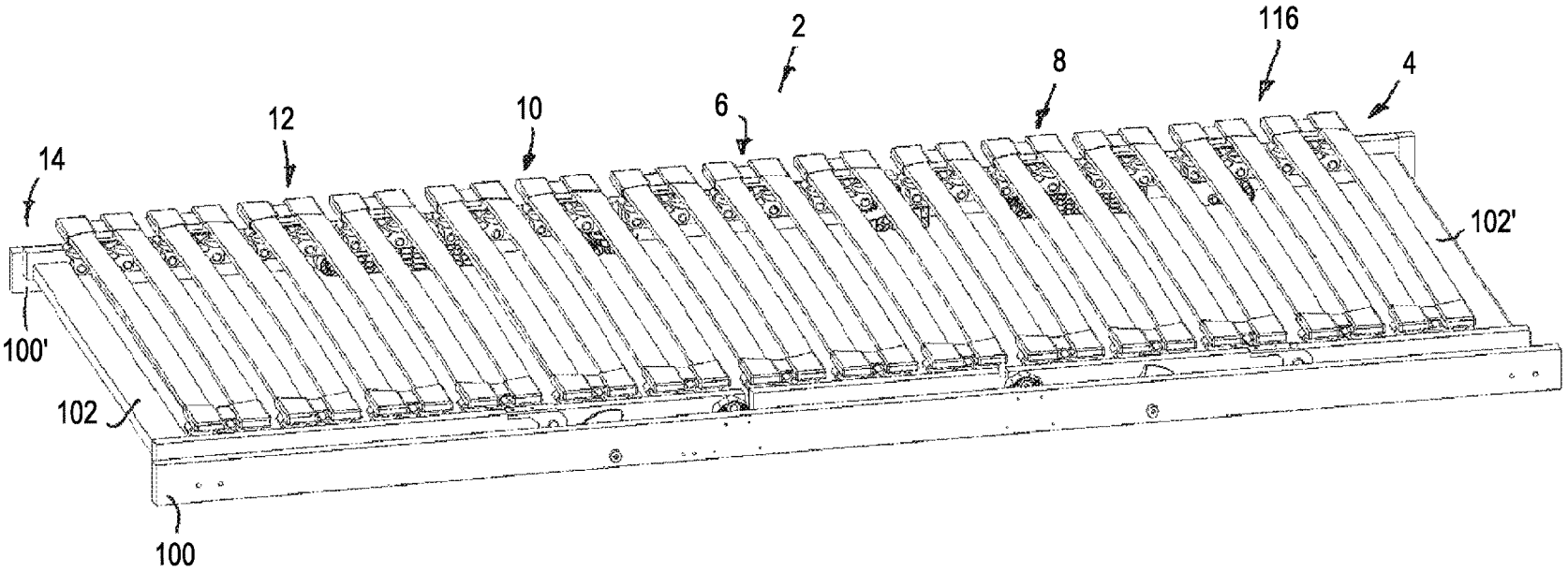
FIG. 18 shows, in the same manner as FIG. 15, a further embodiment of a support apparatus according to the invention in an unadjusted starting position in which the support parts of the support apparatus span an essentially horizontal support plane.

FIG. 18 shows another embodiment of a support apparatus according to the invention, in the form of a slatted frame 2 in its unadjusted starting position in which the support parts 6, 8, 10, 12 together with a neck support part 116 span an essentially horizontal support plane. The neck support part 116 is articulatedly connected to the end of the upper body support part 8 facing away from the center support part 6 so as to be pivotable about a horizontal pivot axis.

Figure 19:
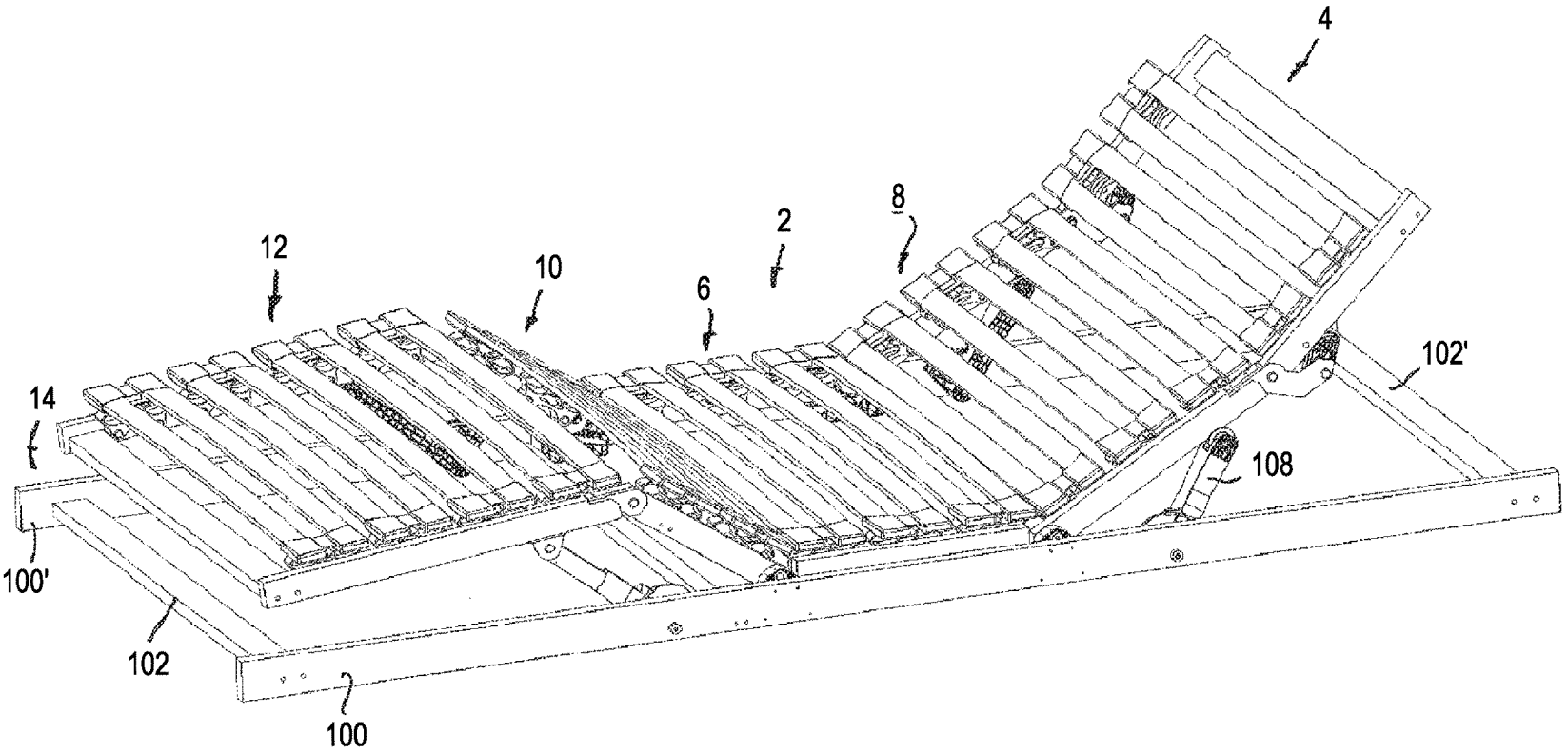
FIG. 19 shows, in the same manner as FIG. 18, the support apparatus according to FIG. 18 in a position which is adjusted between the unadjusted starting position and a maximum end position of the adjustment movement.

FIG. 19 shows the slatted frame 2 in an adjustment position in which the support parts 6, 8, 10, 12, 116 are adjusted relative to the outer frame 14 and the center support part 6.

Figure 20:
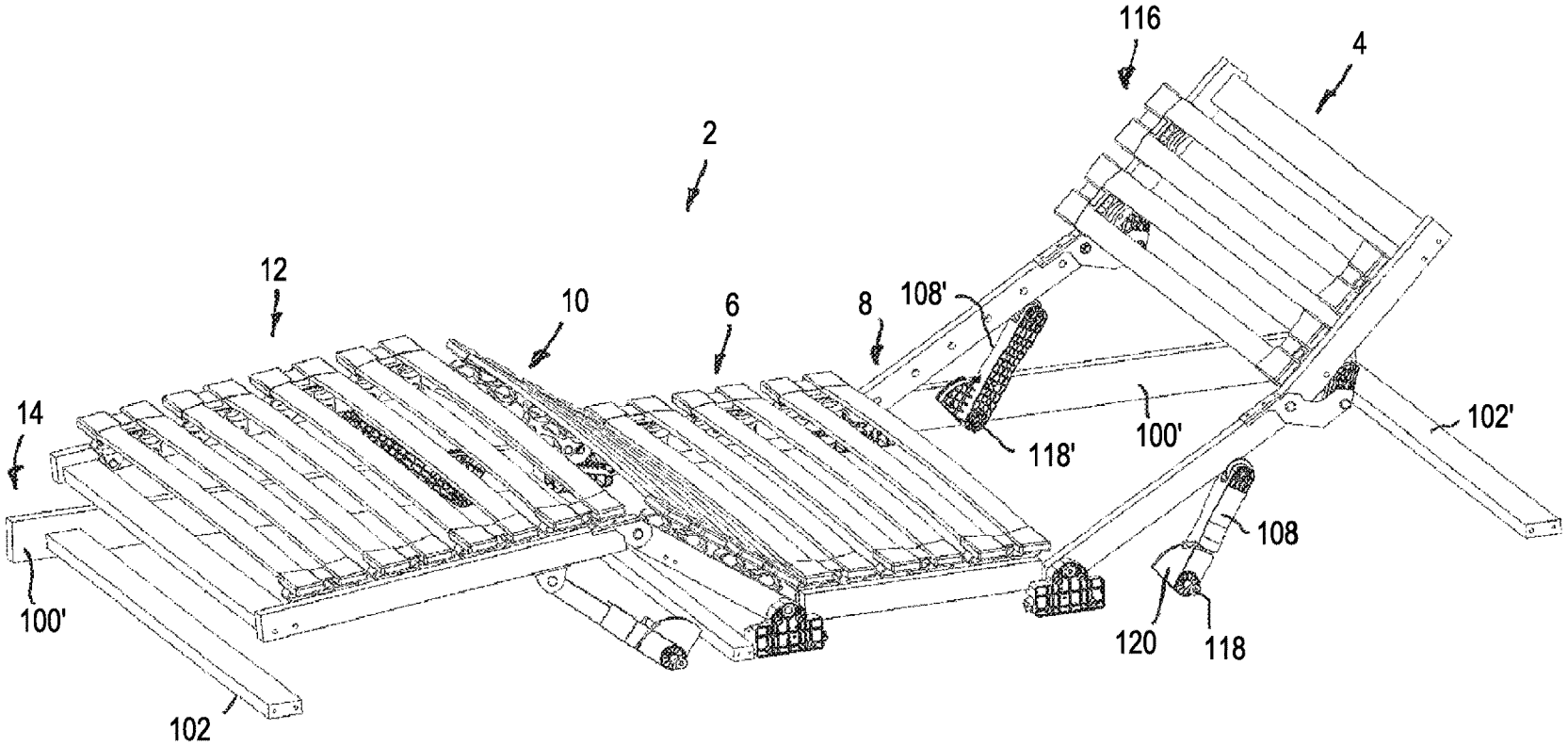
FIG. 20 shows the support apparatus according to FIG. 19, with slats of the support apparatus and a longitudinal beam of the outer frame of the support apparatus omitted for purposes of illustration.

FIG. 20 shows the slatted frame 2 in the adjustment position according to FIG. 19, with the longitudinal beam 100 of the outer frame 14 and several elastic slats of the upper body support part 8 omitted for purposes of illustration.

In the illustrated embodiment, in a kinematic reversal of the embodiment according to FIGS. 15 to 17 the pivot lever 108 is connected to the longitudinal beam 100 of the outer frame 14 so as to be pivotable about a pivot axis 118. In the illustrated embodiment, the pivot lever 108 is supported on the longitudinal beam 100, and thus pivotably fastened thereto. In particular the pivotable connection of a pivot lever 108', which corresponds to the pivot lever 108, about a pivot axis 118' on the longitudinal beam 100' is apparent in FIG. 20. The pull cable of the Bowden cable, omitted in the drawing for purposes of illustration, is fixed to the pivot lever 108, eccentrically with respect to the pivot axis 118, and is guided over a cam disk which in the illustrated embodiment is joined to the pivot lever 108 in one piece, and from there is led to the drive unit 18. The pivot lever 108 pivots counterclockwise about the pivot axis 118 in FIG. 20 under the traction effect of the pull cable of the Bowden cable. In the illustrated embodiment, the pivot axis 118 is defined by a bearing journal which is fastened to the longitudinal beam 100 directly, i.e., without other components in between.

Figure 21:
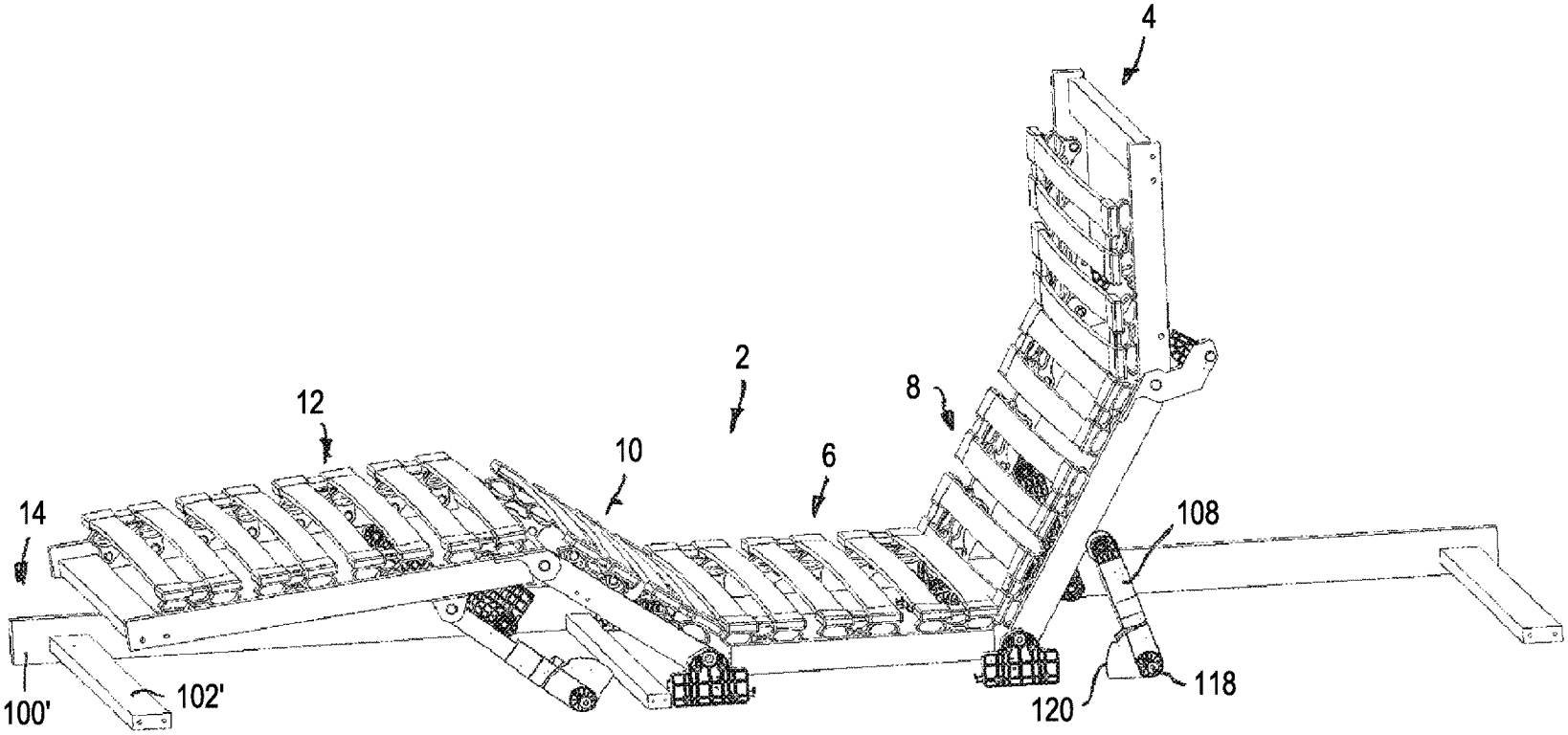
FIG. 21 shows, in an illustration similar to FIG. 20, the support apparatus according to FIG. 18 in a maximally adjusted end position of the adjustment movement.

FIG. 21 shows the end position of the adjustment movement.

Identical or corresponding components are provided with the same reference numerals in the various figures of the drawing and the various embodiments. When components are omitted in the figures of the drawing for reasons of illustration or depiction, the components in question are intended to complement the respective other figures accordingly. It is apparent to those skilled in the art that the features of the individual embodiments are also exchangeable among the embodiments, and the features disclosed with regard to one embodiment may also be provided in identical or corresponding form in the other embodiments. It is also apparent to those skilled in the art that the features disclosed for the individual embodiments in each case further embody the invention taken alone, i.e., independently of the further features of the particular embodiment.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. Adjustable support device adjustable by an electric motor, for supporting padding of seating or reclining furniture, comprising:

a) an outer frame;

b) a base body having a first and second support part which are adjustable relative to one another;

c) at least one of the first and second adjustable support parts is associated with an adjustment element which is in a drive connection with a drive unit including at least one electric motor received in a housing, and the adjustment element is a pivot lever which is pivotable under the traction effect of a pull cable of a Bowden cable, the Bowden cable including the pull cable and a sheathing;

d) the pivot lever being one of:

i) pivotably connected to the associated support part and being supported on a support situated on the outer frame; and, ii) pivotably connected to the outer frame, and with its free end forming a support for the support part to be adjusted;

e) the drive connection between the adjustment element and the at least one electric motor being the Bowden cable, the Bowden cable transmitting a drive force from the electric motor to the adjustment element; and f) the sheathing of the Bowden cable being fixed to the housing of the drive unit.

2. Support device according to claim 1, wherein:

a) the pivot lever which is pivotably supported on the outer frame loosely acts on the support part to be adjusted.

3. Support device according to claim 2, wherein:

a) the support situated on the outer frame is formed on a component which is connected to the outer frame.

4. Support device according to claim 3, wherein:

a) the component connected to the outer frame is an angle bracket having two legs and on whose one leg the pivot lever is supported, and to whose other leg the outer frame is connected.

5. Support device according to claim 1, wherein:

a) the pivot lever is configured a raising lever.

6. Support device according to claim 1, wherein:

a) the support situated on the outer frame is formed on a component which is connected to the outer frame.

7. Support device according to claim 6, wherein:

a) the component connected to the outer frame is an angle bracket having two legs and on whose one leg the pivot lever is supported, and to whose other leg the outer frame is connected.

* * * * *